US005168036A

United States Patent [19]

Doby, Jr.

[11] Patent Number: 5,168,036

[45] Date of Patent: Dec. 1, 1992

[54] KILN CARS

[75] Inventor: Troy L. Doby, Jr., Whitsett, N.C.

[73] Assignee: Resco Products, Inc., Conshohocken, Pa.

[21] Appl. No.: 751,018

[22] Filed: Aug. 28, 1991

[51] Int. Cl.[5] ..... F27D 3/12

[52] U.S. Cl. ..... 432/241; 432/137; 432/253

[58] Field of Search ..... 432/241, 137, 253

[56] References Cited

U.S. PATENT DOCUMENTS

| | | | |
|---|---|---|---|
| 3,997,289 | 12/1976 | Bowers | 432/241 |
| 4,487,579 | 12/1984 | Irwin | 432/137 |
| 4,560,350 | 12/1985 | Doby | 432/137 |
| 4,721,459 | 1/1988 | Fitz | 432/253 |
| 4,836,777 | 6/1989 | Elliott | 432/241 |

*Primary Examiner*—Henry C. Yuen
*Attorney, Agent, or Firm*—Seidel, Gonda, Lavorgna & Monaco

[57] ABSTRACT

A polyhedronal post terminal defining at least one polygonally-shaped cavity passing therethrough. The post terminal also defines at least one hole passing through one of the post terminal's outside wall surfaces, but does not pass through the post terminal outside wall surface which is aligned with and opposes the post terminal outside wall surface having the hole defined therein. The post terminal has at least one ledge portion protruding outwardly from its side wall surface.

In one embodiment, the post terminal has a hook portion extending upwardly from its ledge portion. The hook portion is angularly oriented to the ledge portion's upper surface, and is laterally spaced from the terminal's side wall surface such that a channel is defined therebetween.

In another embodiment, the post terminal has a claw portion extending downwardly from its ledge portion. The claw portion is angularly oriented to the ledge portion's lower surface, and is laterally spaced from the terminal's side wall surface such that a channel is defined therebetween.

51 Claims, 9 Drawing Sheets

FIG. 6
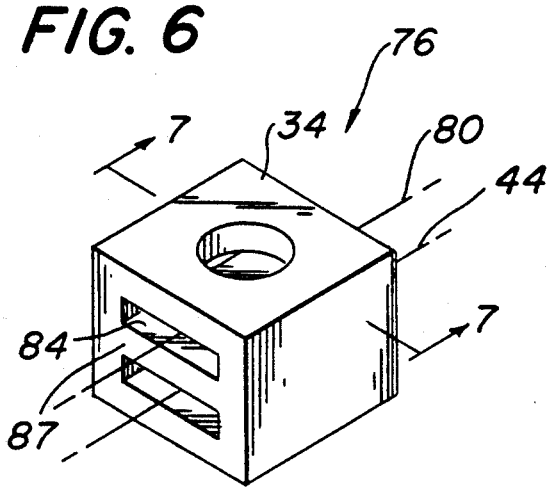
FIG. 7
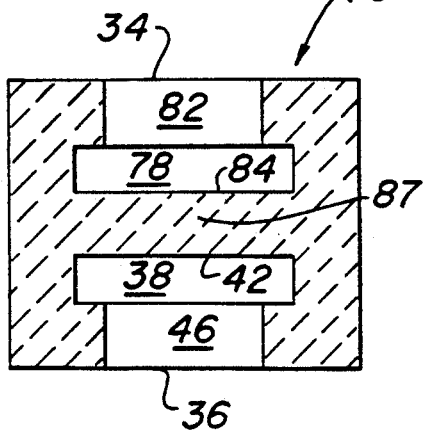
FIG. 8
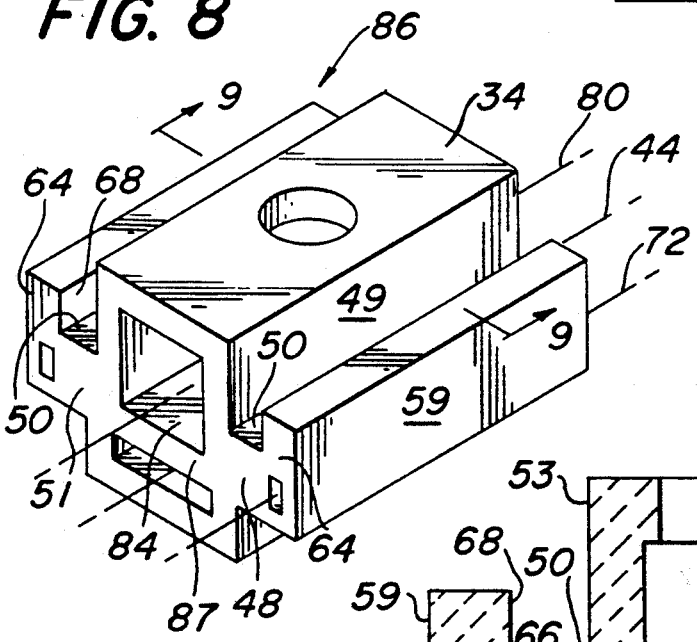
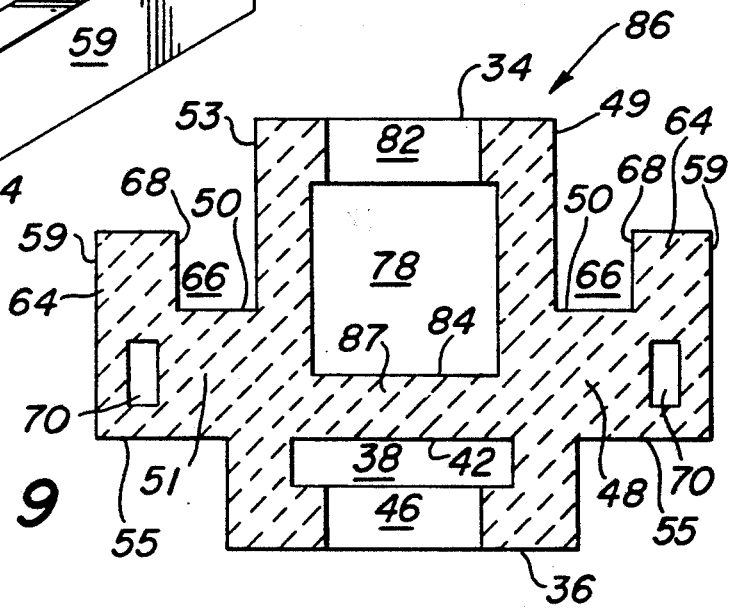
FIG. 9

KILN CARS

FIELD OF THE INVENTION

The invention pertains to an improved kiln car. More specifically, it pertains to novel post terminals which can be used in conjunction with kiln cars. The novel post terminals of the present invention can be used, for example, (a) as supporting means for support posts, (b) as coupling means for a plurality of support posts, (c) as supporting means for deck plates, (d) as supporting means for support beams and/or (e) as anchoring means for vertically-oriented walls.

BACKGROUND OF THE INVENTION

Kiln cars are well known in the industry and have been described in prior publications and patents. These cars typically are used to transport ceramic and/or other refractory material (e.g., bricks, vases, porcelain fixtures, etc.) through heated ovens (i.e., "kilns") for the purpose of curing/firing the material at elevated temperatures.

The chassis of a conventional kiln car is normally made of heavy gage steel. A heat-barrier layer is positioned above the chassis of the kiln car.

The material being fired/cured generally rests on a deck which is typically composed of a plurality of ceramic or refractory-type tiles. The deck, in turn, is supported above the kiln car chassis by a plurality of vertically oriented support posts which pass upwardly from the kiln car chassis through the heat-barrier layer. Sometimes, there are supporting beams positioned between the support posts and the deck plates.

In some instances, the deck plates or support beams rest directly on the upper ends of the posts. However, for better support, it is desirable to have a larger surface area upon which the deck and/or beam can rest. Since it is also desirable to minimize the size and number of physical obstructions between the deck and the heat barrier layer, the support posts are sometimes molded such that their upper ends have a larger surface area than that which would be provided by the diameter of the posts' vertical section. Examples of such types of post designs are illustrated in U.S. Pat. Nos. 4,110,069 and 4,897,034.

Regardless of the type of post design employed, there is one typical and recurring problem inherent thereto. Specifically, the upper portion of the support post, which supports the deck, support beam and/or material being fired, frequently breaks and/or cracks due to the physical and thermal shocks inherent in typical kiln-firing processes.

When the upper supporting end of a support post breaks, the entire post must be replaced. As would be expected, this is a costly and time-consuming process.

To overcome the problem associated with replacing an entire post, many users of kiln cars employ what are commonly known in the industry as "post caps". Post caps are generally manufactured of ceramic or refractory-type materials. The upper surface of a post cap typically has a surface area which is larger than the cross-sectional area of the upper end of a support post.

As indicated by its name, a post cap is generally made to rest on the upper end of a support post. Examples of different types and designs of post caps typically employed in the kiln-firing industry are illustrated in U.S. Pat. Nos. 4,773,805; 4,721,459; 4,348,175; 4,330,276 and 1,665,631.

As with a single molded post having its upper supporting surface enlarged (e.g., those illustrated in U.S. Pat. Nos. 4,897,034 and 4,110,069), post caps also frequently break and/or crack due to the physical and thermal shocks encountered in typical kiln-firing processes. Therefore, while the use of post caps does rectify some of the problems associated with replacing the entire post, the mere use of conventional post caps does not, itself, decrease the frequency of cracks and/or breaks occurring during typical kiln-firing processes.

To the inexperienced lay person, it may seem obvious to mold thicker post caps to provide the desired additional strength. To those skilled in the art, however, this is undesirable since a thicker post cap will absorb a larger portion of the kiln heat, thus requiring the use of more energy to achieve the necessary firing conditions.

Therefore, if not for the loss in strength, a skilled artisan would be led to use smaller/thinner post caps. However, as would be expected, smaller/thinner post caps have a greater tendency of cracking and/or breaking when subjected to the physical and thermal shocks encountered in typical kiln-firing processes. Consequently, the kiln-firing industry has been plagued with a dilemma, since employing a means of satisfying one of the desirable properties for post caps (e.g., using a thicker/larger post cap for added strength) detracts from one of the other highly desirable properties (e.g., minimizing the amount of energy needed to achieve the desired kiln firing conditions).

Although it would have been a welcomed improvement in the kiln-firing industry, prior to the present invention, no one has been able to design and/or fabricate a post cap which can withstand much of the physical and thermal shocks encountered by kiln cars, while not absorbing a substantial amount of additional heat.

Another major problem often encountered in the kiln-firing industry is the shifting and/or buckling of the deck while the kiln car is in use. As stated earlier, kiln cars customarily have decks made from a number of plates which have flat upper and lower surfaces. These plates are generally designed to lay flat on the upper surface of the support posts, post caps or support beams. Since kiln cars are subject to physical and thermal shocks when in use, the deck plates and/or support beams often buckle and shift. This can be catastrophic in the kiln-firing industry since it can result in the deck collapsing while the car is within the kiln. Therefore, it is also extremely desirable to have a means for minimizing the amount of shifting and/or buckling of deck plates when subjected to the normal physical and thermal shocks encountered in typical kiln-firing processes.

As expected, breaks and/or cracks are not limited to post caps. Often, regardless of whether a post cap is employed, the support post itself cracks and/or breaks. When this occurs, the typical response in the kiln-firing industry is to replace the entire post. Obviously, the larger the post the greater its replacement costs (i.e., the cost of replacing a two foot post is less than that of replacing a four foot post). In view of the above, it would also be a welcomed improvement in the kiln-firing industry if a method can be devised for eliminating the need to replace the entire post and/or minimizing the cost of repairing the same.

SUMMARY OF THE INVENTION

It is an object of the present invention to provide a post terminal which has a greater endurance to the normal physical and/or thermal shocks encountered in typical kiln-firing processes.

It is another object of the present invention to provide a post terminal which, while having a greater endurance to the normal physical and thermal shocks encountered in typical kiln-firing processes, absorbs approximately the same amount of heat as does its conventional counterpart.

It is still another object of the present invention to provide a means for reducing the cost of replacing and/or repairing damaged support posts.

It is a further object of the present invention to provide a means for reducing the cost of manufacturing support posts of a given height.

It is still a further object of the present invention to provide a means for minimizing the shifting and/or buckling of deck plates and/or support beams when the same are subjected to the normal physical and thermal shocks encountered in typical kiln-firing processes.

It is even a further object of the present invention to provide a means for anchoring an insulating material retaining wall.

These and other objects are met by the present invention due to the advent of a novel post terminal. The post terminal of the present invention is in the shape of a polyhedron. This post terminal defines at least one polygonally-shaped cavity passing therethrough. The post terminal also defines at least one hole which passes through one of its outside wall surface and opens into the at least one polygonally-shaped cavity. This hole does not, however, pass completely through the opposing post terminal outside wall surface.

The post terminal of the present invention has a first face and a second face which are generally aligned with, and parallel to, one another. The longitudinal axis of the polygonally-shaped cavity is generally parallel to the post terminal's first and second faces; and, the hole passes through only one of the post terminal's aforementioned faces. The post terminal of the present invention further comprises at least one side wall surface which is angularly oriented to the post terminal's first and second faces. This angular orientation generally ranges from between about 30° to about 150°.

In addition, the post terminal has at least one ledge portion protruding outwardly from the terminal's side wall surface. This ledge portion has an upper surface which is angularly oriented to the terminal's side wall surface. This angular orientation generally ranges from between about 45° to about 135°.

In one embodiment of the present invention, the post terminal comprises at least one hook portion extending upwardly from the ledge portion. This hook portion has an inside wall surface which is: (a) angularly oriented to the ledge portion's upper surface, and (b) spaced laterally from the terminal's side wall surface such that a channel is defined therebetween. The angular orientation generally ranges from between about 40° to about 135°.

In another embodiment of the present invention, the post terminal comprises at least one claw portion extending downwardly from its ledge portion. This claw portion has an inside wall surface which is: (a) angularly oriented to the ledge portion's lower surface, and (b) spaced laterally from the terminal's side wall surface such that a channel is defined therebetween. The angular orientation generally ranges from between about 40° to about 135°.

Other objects, aspects and advantages of the present invention will become apparent to those skilled in the art upon reading the following detailed description, when considered in conjunction with the accompanying drawings and appended claims.

BRIEF DESCRIPTION OF THE DRAWINGS

A more complete appreciation of the invention, and many attendant advantages thereof, will be readily obtained as the same becomes better understood by reference to the following detailed description, when considered in conjunction with the accompanying figures briefly described below.

FIG. 6 is an isometric view illustrating one embodiment of a post terminal encompassed by the present invention, useful for example, for coupling together a plurality of support posts.

FIG. 7 is a cross-sectional view of the post terminal illustrated in FIG. 6, taken along line 7—7.

FIG. 8 is an isometric view illustrating one embodiment of a post terminal encompassed by the present invention, useful, for example, for coupling together a plurality of support posts, while including means for minimizing the shifting and/or buckling of deck plates and/or support beams positioned thereon.

FIG. 9 is a cross-sectional view of the post terminal illustrated in FIG. 8, taken along line 9—9.

DETAILED DESCRIPTION OF THE INVENTION

Figure 1:
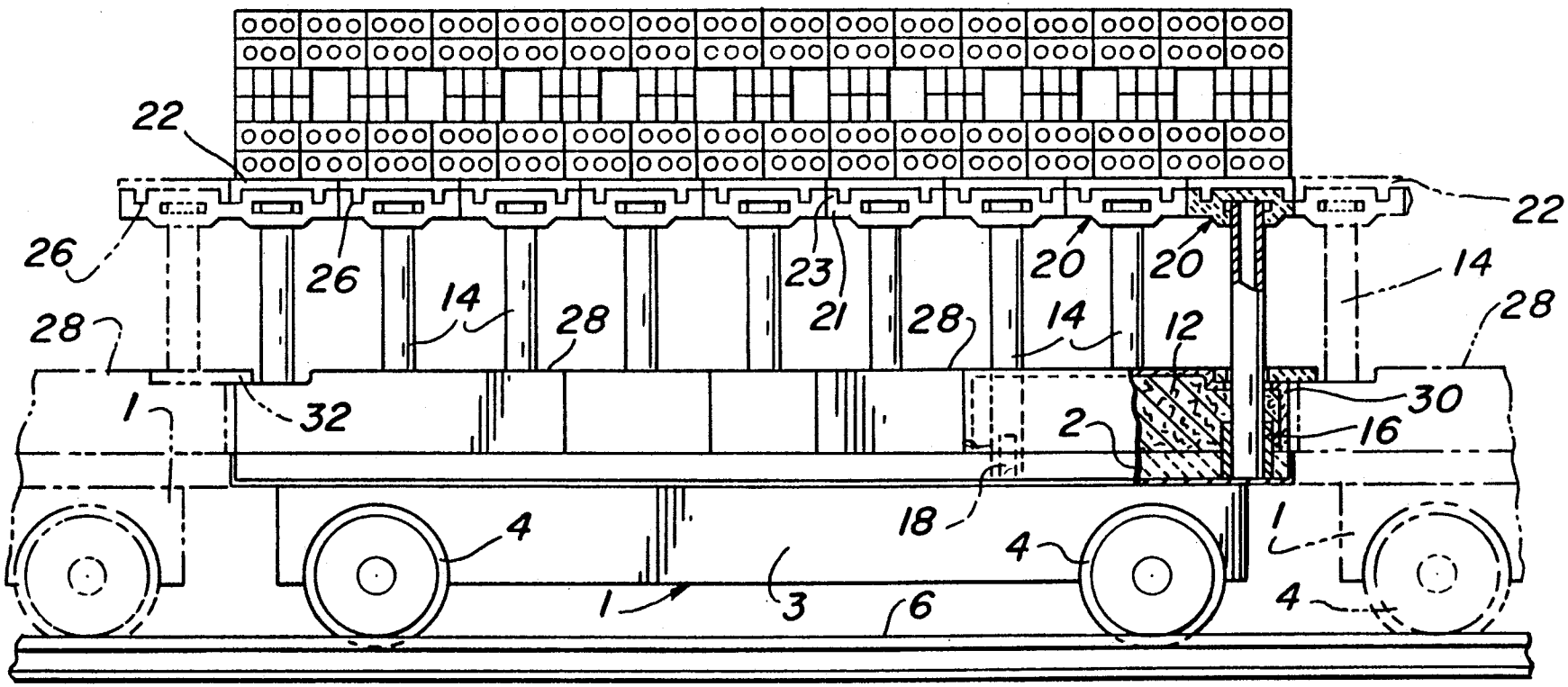
FIG. 1 is a side, partially sectionalized, elevation view of an improved kiln car employing one embodiment of a post terminal encompassed by the present invention.

The post terminal of the present invention remedies many of the problems which have been plaguing the kiln-firing industry for many years. These novel post terminals can be used, for example, as: (a) supporting means for support posts, (b) coupling means for a plurality of support posts, (c) supporting means for deck plates, (d) supporting means for support beams and/or (e) anchoring means for vertically-oriented retention walls.

The post terminal of the present invention is in the shape of a polyhedron. Any suitably shaped polyhedron shape can be employed.

Preferably, the post terminal of the present invention has at least two opposing parallel faces. Examples of suitable polyhedronal shapes, having at least two parallel faces, include, but are not limited to: triangular, tetragonal, square, rectangular, pentagonal, hexagonal, heptagonal, octagonal, cylindrical, etc. The most desirable shape depends largely upon the specific application by the user.

The post terminal of the present invention also defines at least one polygonally-shaped cavity passing completely therethrough. In the presently preferred instance wherein the post terminal is in the shape of a polyhedron having at least two parallel faces, the longitudinal axis of the polygonally-shaped cavity is generally parallel to the two post terminal parallel faces.

The polygonally-shaped cavity can also take any suitable shape (e.g., triangular, tetragonal, square, rectangular, pentagonal, hexagonal, heptagonal, octagonal, cylindrical, etc.). The most desirable shape, again, depends largely upon the specific application by the user.

In the post terminal encompassed by the present invention, at least one hole is defined therein which passes through the outside wall surface of the post terminal and opens into the aforementioned polygonally-shaped cavity. This hole, however, does not pass completely through the opposing post terminal outside wall surface.

In the presently preferred instance, wherein the post terminal is in the shape of a polyhedron having at least two parallel faces, the aforementioned at least one hole passes through one of the post terminal's parallel faces while not passing through the opposing post terminal's parallel face.

In practice, one end of a support post passes through the aforementioned hole defined in the post terminal outside wall surface. The support post end then abuts at least one of the inside wall surfaces defined by the polygonally-shaped cavity.

In view of the above, the aforementioned hole defined in the post terminal outside wall surface and polygonally-shaped cavity, must both be dimensioned such that the support post end can easily pass therethrough. Moreover, it is preferable that the hole defined in the post terminal outside wall surface has the same shape of, but is slightly larger than, the support post end passing therethrough.

The polygonally-shaped cavity passing through the post terminal is positioned such that the thickness and width of the post terminal side walls have sufficient strength to withstand much of the normal physical and thermal shocks encountered in typical kiln-firing processes. The wall thickness depends largely upon the specific conditions which the specific kiln car is subjected and the material from which the post terminal is made.

It has been observed, however, that, in typical kiln-firing conditions, the distance between any inside wall surface defined by the cavity and the nearest outside wall surface of the post terminal is generally at least one quarter of an inch. Preferably, the distance ranges between about one quarter of an inch and about six inches, more preferably between about three eighths of an inch and about five inches, and even more preferably between about one half of an inch and about four inches.

Due to the novel design of the post terminals encompassed by the present invention, they generally have vertical side wall portions which are substantially wider than those of their conventional counterparts. However, due to the presence of the at least one polygonally-shaped cavity passing therethrough, the amount of heat absorbed by the novel post terminals of the present invention is not significantly greater than that absorbed by their conventional counterparts.

Accordingly, the post terminals of the present invention provide a greater resistance to breaking and/or cracking when subjected to the normal physical and thermal shocks typically encountered in kiln-firing processes. Since the post terminals of the present invention provide this greater endurance, without increasing the amount of heat absorption, they will be a welcome improvement in the kiln-firing industry.

The post terminal of the present invention also has a side wall surface which is angularly oriented to the terminal's at least two parallel faces. The angular orientation generally ranges from between about 30° to about 150°. Preferably, the angular orientation ranges from between about 45° to about 135°, and more preferably, from between about 80° to about 100°.

In addition to the side wall surface, the post terminal of the present invention also includes at least one ledge portion protruding outwardly therefrom. This ledge portion has an upper surface which is angularly oriented to the terminal's side wall surface. This angular orientation generally ranges from between about 45° to about 135°. Preferably, the angular orientation ranges from between about 60° to about 120°, and more preferably, from between about 80° to about 100°.

In one specific embodiment, the post terminal of the present invention also comprises at least one hook portion extending upwardly from its at least one ledge portion. This hook portion has an inside wall surface which is angularly oriented to the ledge portion's upper surface. The angular orientation generally ranges from between about 45° to about 135°. Preferably, the angle of orientation ranges from between about 60° to about 120°, and more preferably, from between about 80° to about 100°.

In addition, the terminal's at least one hook portion is spaced laterally from its side wall surface. This lateral spacing defines a channel between: (a) the terminal's side wall surface, (b) the ledge portion's upper surface, and (c) the hook portion's inside wall surface.

In another specific embodiment, the post terminal of the present invention comprises at least one claw portion extending downwardly from its at least one ledge portion. This claw portion has an inside wall surface which is angularly oriented to the ledge portion's upper surface. The angular orientation generally ranges from between about 45° to about 135°. Preferably, the angular orientation ranges from between about 60° to about 120°, and more preferably from between about 80° to about 100°.

In addition, the terminal's at least one claw portion is spaced laterally from its side wall surface. This lateral spacing defines a channel between: (a) the terminal's side wall surface, (b) the ledge portion's lower surface and, (c) the claw portion's inside wall surface.

Figure 20:
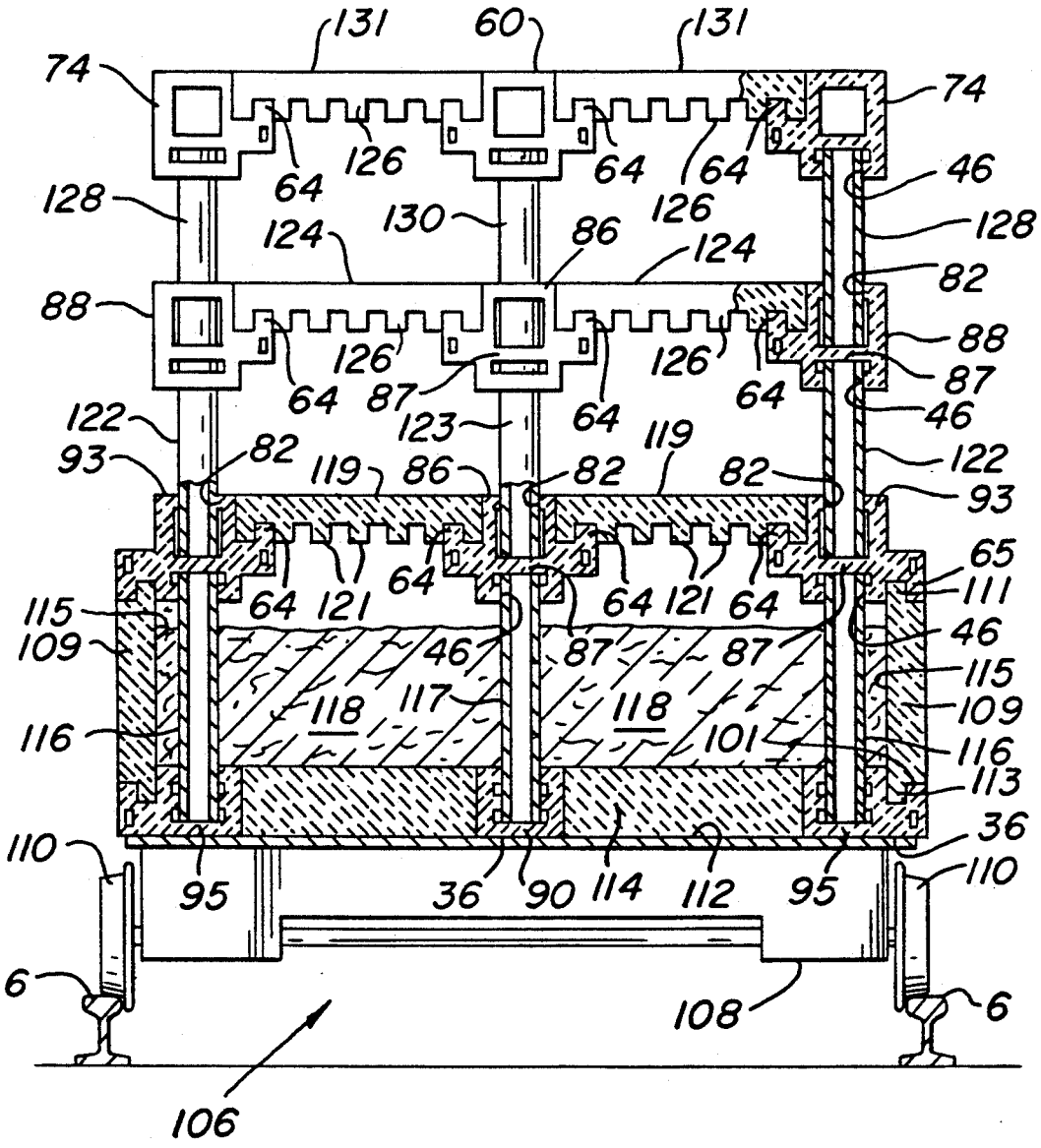
FIG. 20 is an end, partially sectionalized, elevation view of an improved kiln car employing the post terminals illustrated in FIGS. 2-5, 8-13 and 16-19.

An improved kiln car can be manufactured by employing the post terminals of the present invention. An example of one such improved kiln car is illustrated in FIGS. 1 and 20.

FIG. 1 is a side, partially-sectionalized, elevation view of an improved kiln car employing one embodiment of a post terminal encompassed by the present invention. The improved kiln car illustrated in FIG. 1 is generally represented by reference numeral 1.

Referring now to FIG. 1, kiln car 1 comprises a chassis 3. Moreover, kiln car 1 also generally comprises a means for implementing its movement through a kiln. Any suitable means of implementing movement, known to those skilled in the art, can be employed. The means by which movement of kiln car 1 is implemented comprises flanged running wheel 4 and rail 6.

A protective layer 2 is generally placed over the kiln car chassis 3. This protective layer minimizes the amount of heat absorbed by kiln car chassis 3. Protective layer 2 can be made of any suitable insulating material. Generally protective layer 2 comprises of a layer of lightweight refractory material.

Conventional fibrous insulating refractory material 12 is generally placed over protective layer 2. Insulating material 12 also minimizes the amount of heat absorbed by kiln car chassis 3.

Kiln car 1 also comprises anchoring means designed to anchor support posts 14 thereto. The anchoring means generally extends upwardly from the kiln car chassis. The anchoring means can be any suitable size or shape. For example, they can be in the form of an anchoring sleeve 16 or an anchoring post 18.

Kiln car 1 also comprises a plurality of generally vertical support posts 14. Support posts 14 can have any suitable size and/or shape. Generally, support posts 14 are hollowed, cylindrical members comprised of ceramic or refractory-type materials.

Support posts 14 are topped with one of the novel post terminals of the present invention. Any post terminal encompassed by the present invention can be employed.

The post terminals illustrated in FIG. 1 are represented by reference numeral 20. Examples of possible configurations and compositions of the post terminals encompassed by the present invention will be discussed later.

In FIG. 1, post terminals 20 support deck plates 22 upon which the material to be fired (e.g., bricks 10) is stacked. Post terminals 20 can also support support beams (not shown) which, in turn, support deck plates. Post terminals 20 include ledge portion 21 and hook portion 23.

Deck plates 22 and/or support beams (not shown) can be made from any suitable materials. Generally, deck plates and support beams are comprised of fired ceramic or refractory material.

In accordance with one embodiment of the present invention, deck plates 22 comprise ears 26 extending downwardly from their lower surface. Ears 26 are positioned and dimensioned to fit into the channel defined by the post terminal outside wall surface, the ledge portion's upper surface, and the hook portion's inside wall surface. Ears 26 limit the movement of deck plates 22 while kiln car 1 is in use.

The kiln car illustrated in FIG. 1 also comprises the optional means for confining the body of fibrous insulating material 12 to the kiln car chassis. The optional means for confining insulating material 12 illustrated in FIG. 1 comprises dome-shaped members 28 which are positioned over insulating material 12 in order to prevent the insulating material from substantially moving during use. If employed, dome-shaped members 28 generally have openings 30 in their upper portions. Openings 30 are positioned and dimensioned to vertically coincide with anchoring means 16 and/or 18, and support posts 14.

Another optional means for confining insulating material 12 such that it does not substantially move during use comprises the implementation of vertically-oriented retaining walls. This embodiment, which is illustrated in FIG. 20, will be discussed later.

It can easily be envisioned from FIG. 1 that a train of such improved kiln cars can be employed, in an end-to-end abutting relationship. In such a configuration, an overlapping heat barrier means 32 can be employed. As is evident from its name, heat barrier means 32 blocks at least a portion of the kiln heat from passing between adjacent kiln car chassis.

As stated earlier, the post terminals encompassed by the present invention can have any suitable polyhedronal configuration. Examples of such suitable configurations include, but are not limited to, those configurations illustrated in FIGS. 1–19 and 21–30 and/or any combination thereof. The embodiment of the post terminal illustrated in FIG. 1 has already been discussed.

Figure 2:
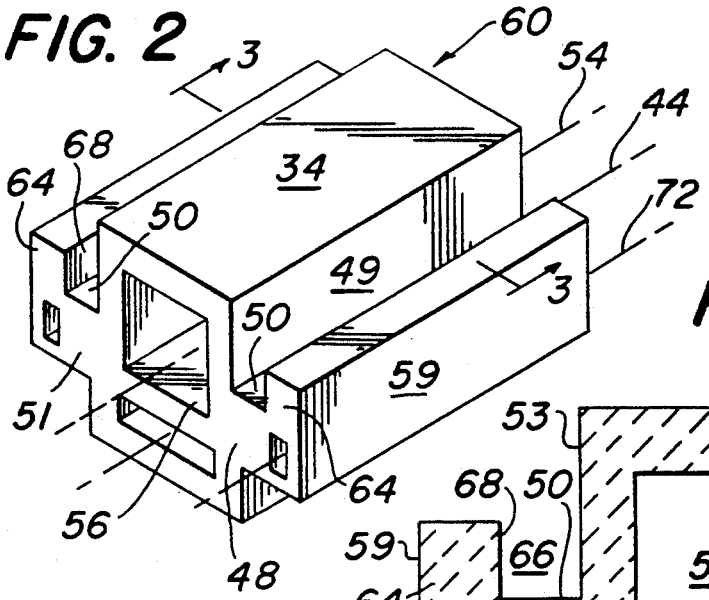
FIG. 2 is an isometric view illustrating one embodiment of a post-terminal encompassed by the present invention, including means for minimizing the shifting and/or buckling of deck plates and/or support beams positioned thereon.
Figure 3:
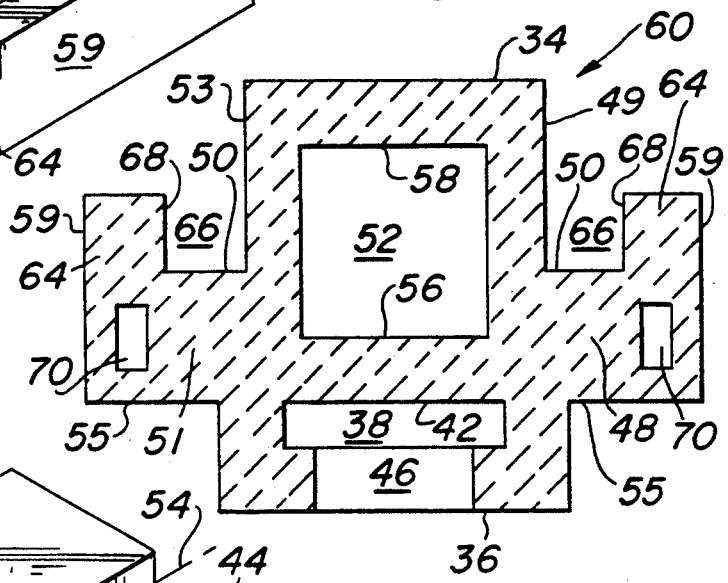
FIG. 3 is a cross-sectional view of the post terminal illustrated in FIG. 2, taken along line 3—3.

FIGS. 2 and 3 illustrate one embodiment of a post terminal encompassed by the present invention. The post terminal illustrated in FIGS. 2 and 3 is generally represented by reference numeral 60.

Post terminal 60 comprises at least two parallel faces 34 and 36. Post terminal 60 also defines at least one polygonally-shaped cavity 38 passing therethrough. The longitudinal axis 44 of cavity 38 is generally parallel to the aforementioned two post terminal parallel faces 34 and 36.

Polygonally-shaped cavity 38 can have any suitable configuration. Generally, cavity 38 defines at least one planer surface which is parallel to post terminal parallel faces 34 and 36. Preferably, the inside wall surface defined by cavity 38, against which the end of the support post will abut, has the same configuration as the end of the support post.

In at least one of the aforementioned two post terminal parallel faces (i.e., parallel face 36), at least one hole 46 is defined therein which passes therethrough and which opens into cavity 38 (see, e.g., FIG. 3). Hole 46 does not, however, pass through the opposing post terminal parallel face 34.

Hole 46 can have any suitable size and configuration. Generally, it will have the same configuration of the post terminal end which will pass therethrough. Preferably, hole 46 is slightly larger than the support post end which will pass therethrough. In most instances, the longitudinal axis of hole 46 is generally perpendicular to the longitudinal axis 44 of cavity 38.

Post terminal 60 further comprises ledge portions 48 and 51 protruding outwardly from its outside wall surfaces 49 and 53. With this configuration, deck plates can be designed to rest on the upper surface 50 of ledge portions 48 and 51.

The distance between ledge upper surface 50 and ledge lower surface 55 depends largely upon the specific conditions to which the specific kiln car is subjected and the material from which the post terminal is constructed. It has been observed, however, that, under typical kiln-firing conditions, the distance between ledge upper wall surface 50 and ledge lower wall surface 55 is at least about one half of an inch. Preferably, the distance between upper wall surface 50 and lower wall surface 55 ranges between about one half of an inch and about six inches, more preferably, between about five eighths of an inch and about five inches, and even more preferably, between about three quarters of an inch and about four inches.

Post terminal 60 can also optionally comprise a second polygonally-shaped cavity 52 passing therethrough. Optional cavity 52 enables the fabrication of a thicker, stronger post terminal without having substantial adverse affects on the amount of heat absorption. For an example of a post terminal encompassed by this present invention, wherein the optional, second polygonally-shaped cavity is not present, see item 20 of FIG. 1.

While not necessary, it is presently preferable that the longitudinal axis 54 of optional cavity 52 be generally parallel to that of the polygonally-shaped cavity 38. It is even more preferred that both longitudinal axes 54 and 44 are also generally parallel to two post terminal parallel faces 34 and 36.

Moreover, it is also within the scope of this present invention to have hole 46 pass through, not only post terminal parallel face 36, but also post terminal inside wall surfaces 42 and 56. However, as stated before, if this embodiment is employed, hole 46 cannot pass through opposing post terminal parallel face 34.

In practice, if hole 46 passes through both post terminal parallel face 36 and inside wall surfaces 42 and 56, one end of a support post will pass therethrough and abut against opposing post terminal inside wall surface 58 defined by cavity 52. If this embodiment is employed, hole 46 and cavities 38 and 52 must be dimensioned such that a support post end can pass completely through to, and abut against, opposing post terminal inside wall surface 58.

Post terminal 60 further comprises hook portions 64 extending upwardly from ledge portions 48 and 51. Hook portions 64 can have any suitable size or configuration. Preferably, hook portions 64 are generally perpendicular to ledge portions 48 and 51.

The inside wall surface 68 of hook portions 64 is spaced laterally from the post terminal outside wall surfaces 49 and 53. By having this configuration, channels 66 are defined by hook portion inside wall surfaces 68, ledge upper wall surfaces 50 and post terminal outside wall surfaces 49 and 53. The horizontal distance between hook portion inside wall surface 68 and hook portion outside wall surface 59 is generally at least about one half of an inch. Preferably, the horizontal distance ranges between about one half of an inch and about six inches, more preferably, from between about five eighths of an inch and about five inches, and even more preferably, from between about three quarters of an inch and about four inches.

The combination of ledge portions 48 and 51 and hook portions 64 are especially useful for supporting deck plates and/or support beams. As illustrated in FIGS. 1 and 20, the deck plates and/or support beams to be positioned thereon are designed to include claw portions or "ears" extending downwardly therefrom. Preferably, these claw portions are positioned and dimensioned to fit snugly within channels 66. More preferably, the vertical distance between ledge upper surface 50 and post terminal parallel face 34 is substantially the same width of the deck plate and/or beam positioned thereon, including the claw portion (see, for example, FIG. 20). By having such a width, when the deck plate and/or support beam is positioned in place, the upper surface of the deck plate and/or support beam will correspond with post terminal parallel face 34.

By the advent of this novel hook and claw design, a means is now provided which greatly minimizes the amount of shifting and buckling by deck plates and/or support beams when subjected to the normal physical and thermal shocks encountered in typical kiln-firing processes.

Figure 4:
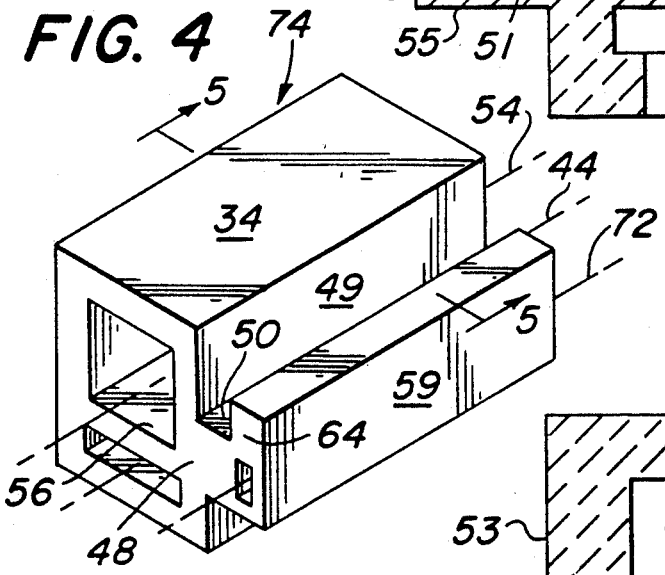
FIG. 4 is an isometric view illustrating one embodiment of a post terminal encompassed by the present invention, including means for minimizing the shifting and/or buckling of deck plates and/or support beams positioned thereon.
Figure 5:
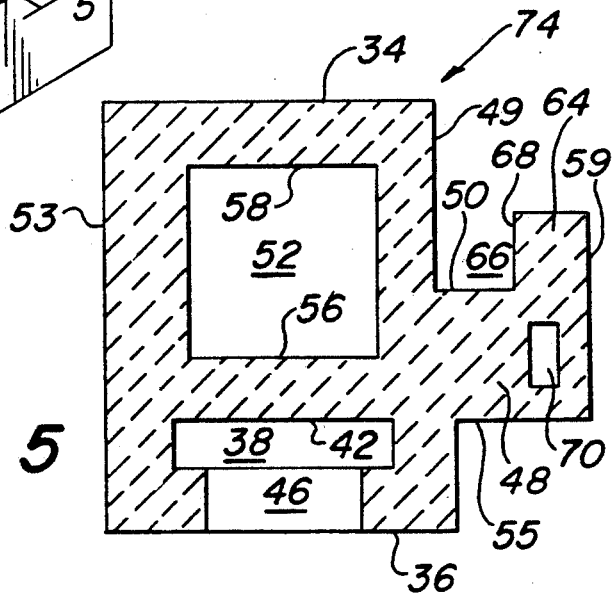
FIG. 5 is a cross-sectional view of the post terminal illustrated in FIG. 4, taken along line 5—5.

Post terminal 60 can also be designed such that the ledge portions 48 protrudes, and the hook portion extends, from only one of the post terminal's outside wall surfaces. In this instance, the post terminal can be employed on the support posts positioned on the perimeter of a kiln car. This embodiment of a post terminal encompassed by the present invention is illustrated in FIGS. 4 and 5 which will be discussed later.

Post terminal 60 can, itself, be employed on the support posts positioned on the perimeter of a kiln car. If employed in this location, a sealing means (not shown) can be positioned within the peripheral channel defined by post terminal outside wall surface 49 or 53, ledge upper wall surface 50 and hook portion inside wall surface 68 (i.e., in that channel which does not have a deck plate and/or support beam attached thereto or positioned thereon).

This sealing means can be comprised of any suitable insulating material. Preferably, the sealing means is dimensioned such that, when fitted into channel 66, its edges and/or surfaces are in close relationship with the inside wall surface of the kiln, thus minimizing the amount of heat loss.

Optionally, post terminal 60 also comprises other polygonally-shaped cavities 70 passing therethrough. While not necessary, it is preferable that the longitudinal axes 72 of cavities 70 are generally parallel to that of cavity 38. It is even more preferred that the longitudinal axes of cavities 38 and 70 are also generally parallel to two post terminal parallel faces 34 and 36. Cavities 70 enable the fabrication of an even thicker and stronger post terminal, without having substantial adverse affects on the amount of heat absorption.

FIGS. 4 and 5 illustrate another embodiment of a post terminal encompassed by the present invention. As stated earlier, the configuration of the post terminal illustrated in FIGS. 4 and 5 is especially useful when employed in conjunction with those support posts positioned along the side perimeters of a kiln car. The post terminal illustrated in FIGS. 4 and 5 is generally represented by reference numeral 74.

Post terminal 74 comprises at least two parallel faces 34 and 36. Post terminal 74 also defines at least one polygonally-shaped cavity 38 passing therethrough, wherein the longitudinal axis 44 of cavity 38 is generally parallel to post terminal parallel faces 34 and 36. Moreover, post terminal 74 also defines at least one hole 46 which, while passing through parallel face 36, does not pass through opposing parallel face 34.

Figure 10:
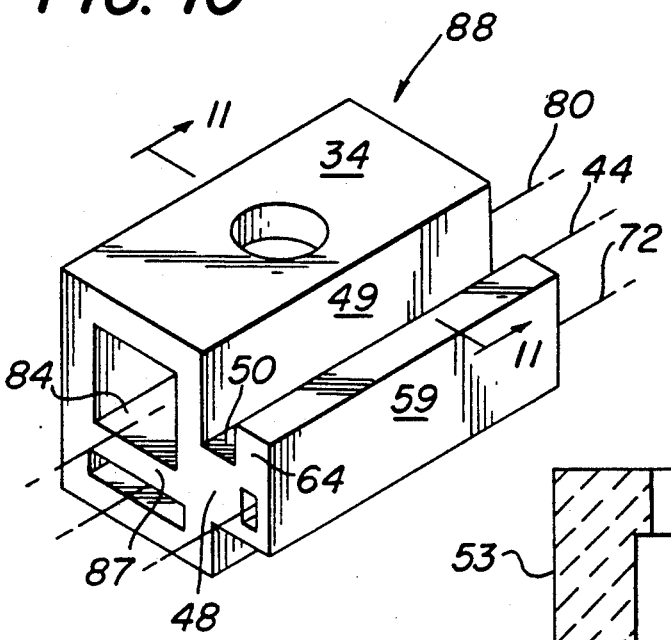
FIG. 10 is an isometric view illustrating one embodiment of a post terminal encompassed by the present invention, useful, for example, for coupling together a plurality of support posts, while including means for minimizing the shifting and/or buckling of deck plates and/or support beams positioned thereon.
Figure 11:
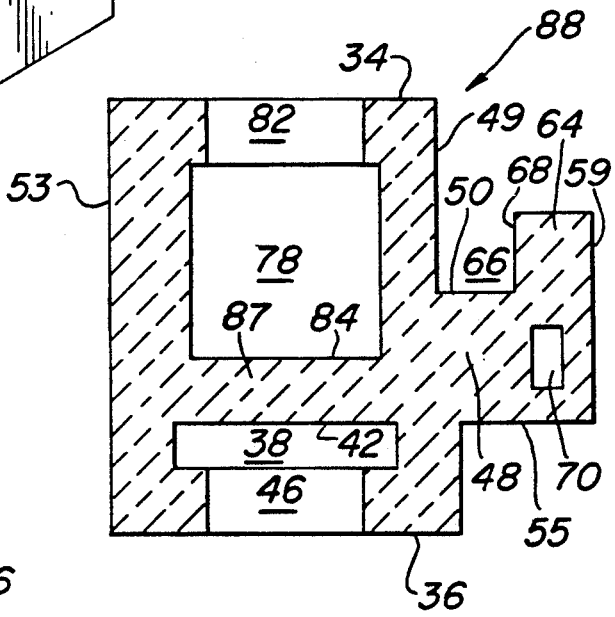
FIG. 11 is a cross-sectional view of the post terminal illustrated in FIG. 10, taken along line 11—11.

As with the post terminal illustrated in FIGS. 2 and 3 (i.e., post terminal 60), post terminal 74 can also, optionally, define at least one hole passing through post terminal face 34 which, while opening into cavity 52, does not pass through opposing post terminal parallel face 36. This embodiment of a post terminal encompassed by the present invention is illustrated in FIGS. 10 and 11 which will be discussed later.

As with all other post terminals encompassed by the present invention, when post terminal 74 is used in practice, one end of a support post passes through hole 46 and abuts opposing post terminal inside wall surface 42 defined by cavity 38.

Also similar to the post terminal illustrated in FIGS. 2 and 3 (i.e., post terminal 60), post terminal 74 has channel 66 which is defined between the inside wall surface 68 of hook portion 64, the upper surface 50 of ledge portion 48 and post terminal outside wall surface 49. As stated earlier, in practice, it is generally preferred to employ deck plates and/or support beams which have claw portions protruding downwardly therefrom, and which are positioned and dimensioned to fit into channel 66.

Optionally, however, it is also within the scope of this invention to have the deck plates and/or support beams rest on the post terminal parallel face 34. In this instance, it is preferable to position a sealing means (not shown) into channel 66. As stated earlier, this sealing means is preferably dimensioned such that it fits into channel 66 and its surfaces and/or edges are in close adjacent relationship with the inside wall surface of the kiln.

Due to the novel design of the post terminals disclosed herein, the cost of repairing, replacing and/or producing support posts can be significantly decreased. Embodiments of post terminals useful for this purpose are illustrated in FIGS. 6–11, 16, 17, 20, 29 and 30.

The post terminal illustrated in FIGS. 6 and 7 is generally represented by reference numeral 76. Post terminal 76 comprises at least two parallel faces 34 and 36. Post terminal 76 also defines at least one polygonally-shaped cavity 38 passing therethrough. The longitudinal axis 44 of cavity 38 is generally parallel to post terminal parallel faces 34 and 36. Moreover, post terminal 76 also defines at least one hole 46 which, while passing through parallel face 36, does not pass through opposing parallel face 34.

Post terminal 76 also defines a second polygonally-shaped cavity 78 passing therethrough. The longitudinal axis 80 of cavity 78 is generally parallel that of cavity 38 and to the two post terminal parallel faces 34 and 36. Moreover, post terminal 76 also defines at least one hole 82 which passes through post terminal parallel 34 and which opens into cavity 78. Hole 82 does not, however, pass through opposing post terminal parallel face 36.

In practice, one end of a first support post passes through hole 46 and abuts opposing post terminal inside wall surface 42 defined by cavity 38. Then, one end of a second support post passes through hole 82 and abuts opposing post terminal inside wall surface 84 defined by cavity 78. The presence of wall portion 87 between cavities 38 and 78 prevents: (a) hole 46 from passing through opposing post terminal parallel face 34 and (b) hole 82 from passing through opposing post terminal parallel face 36.

By employing post terminal 76, a support post of a given length can be manufactured by employing, in conjunction therewith, a plurality of shorter length support posts. This practice will decrease the cost of manufacturing support posts of a given length.

Moreover, post terminal 76 can also be employed as a means for reducing the cost of repairing damaged support posts. Specifically, the damaged portion of the post can be cut away leaving a shorter, undamaged support post. The upper end of the undamaged support post can be fitted through post terminal hole 46 such that the undamaged end abuts post terminal inside wall surface 42 defined by cavity 38. Thereafter, the lower end of a second replacement support post can be fitted through post terminal hole 82 until it abuts post terminal inside wall surface 84 defined by cavity 78. The length of this second support post should be such that, when positioned in post terminal 76, the upper end of the second support post corresponds with the upper ends of the other undamaged kiln car support posts. Therefore, the overall length of the repaired support post should be substantially the same as that of the original support posts.

FIGS. 8 and 9 illustrate yet another embodiment of a post terminal encompassed by the present invention. The post terminal illustrated in FIGS. 8 and 9 is generally represented by reference numeral 86.

As can be seen, post terminal 86 combines features from post terminal 60 (i.e., FIGS. 2 and 3) and post terminal 76 (i.e., FIGS. 6 and 7). Specifically, post terminal 86 comprises at least two parallel faces 34 and 36. Post terminal 86 also defines at least one polygonally-shaped cavity 38 passing therethrough. The longitudinal axis 44 of cavity 38 is generally parallel to post terminal parallel faces 34 and 36. Moreover, post terminal 86 also defines at least one hole 46 which, while passing through post terminal parallel face 36, does not pass through opposing post terminal parallel face 34.

As with post terminal 60 (i.e., FIGS. 2 and 3), post terminal 86 also comprises ledge portions 48 and 51 protruding outwardly from post terminal outside wall surfaces 49 and 53, respectively. Post terminal 86 also comprises hook portions 64 positioned laterally from post terminal outside wall surfaces 49 and 53 and extending upwardly from ledge portions 48 and 51, respectively.

On the other hand, as with post terminal 76 (i.e., FIGS. 6 and 7), post terminal 86 defines a second polygonally-shaped cavity 78 passing therethrough. The longitudinal axis 80 of cavity 78 is generally parallel to that of cavity 38 and to the two post terminal parallel faces 34 and 36. Moreover, post terminal 86 also defines a second hole 82 which, while passing through post terminal parallel face 34, does not pass through opposing post terminal parallel face 36.

In practice, one end of a first support post passes through hole 46 and abuts opposing post terminal inside wall surface 42 defined by cavity 38. Then, one end of a second support post passes through hole 82 and abuts opposing post terminal inside wall surface 84 defined by cavity 78. Thereafter, deck plates and/or support beams having downwardly extending claw portions are fitted into channels 66 defined by hook portion inside wall surfaces 68, ledge upper surface 50 and post terminal outside wall surfaces 49 and 53. As can be seen, by employing post terminal 86, a multi-tiered kiln car can be easily manufactured.

FIGS. 10 and 11 illustrate even another embodiment of a post terminal encompassed by the present invention. The post terminal illustrated in FIGS. 10 and 11 is generally represented by reference numeral 88.

Post terminal 88 comprises some of the features of post terminal 74 (i.e., FIGS. 4 and 5) and post terminal 76 (i.e., FIGS. 6 and 7). Specifically, as does post terminal 74, post terminal 88 comprises at least two parallel faces 34 and 36. Post terminal 88 also defines at least one polygonally-shaped cavity 38 passing therethrough. The longitudinal axis 44 of cavity 38 is generally parallel to post terminal parallel faces 34 and 36. Moreover, post terminal 88 also defines at least one hole 46 which, while passing through post terminal parallel 36, does not pass through opposing post terminal parallel 34.

Post terminal 88 also comprises ledge portion 48 protruding outwardly from post terminal outside wall surface 49. Moreover, post terminal 88 also comprises hook portion 64 spaced laterally from post terminal outside wall surface 49 and extending upwardly from ledge portion 48.

On the other hand, as with post terminal 76 (i.e., FIGS. 6 and 7), post terminal 88 defines a second polygonally-shaped cavity 78 passing therethrough. The longitudinal axis 80 of cavity 78 is generally parallel to that of cavity 38 and to the two post terminal parallel faces 34 and 36. Moreover, post terminal 88 also defines a second hole 82 which, while passing through parallel face 34, does not pass through opposing parallel face 36.

In practice, one end of a first support post passes through hole 46 and abuts opposing post terminal inside wall surface 42 defined by cavity 38. Then, one end of a second support post passes through hole 82 and abuts opposing post terminal inside wall surface 84 defined by cavity 78. Thereafter, deck plates and/or support beams having downwardly extending claw portions are fitted into channel 66 defined by hook portion inside wall surface 68, ledge upper surface 50 and post terminal outside wall surface 49. As can be seen, by employing post terminal 88, a multi-tiered kiln car can be easily manufactured.

Figure 12:
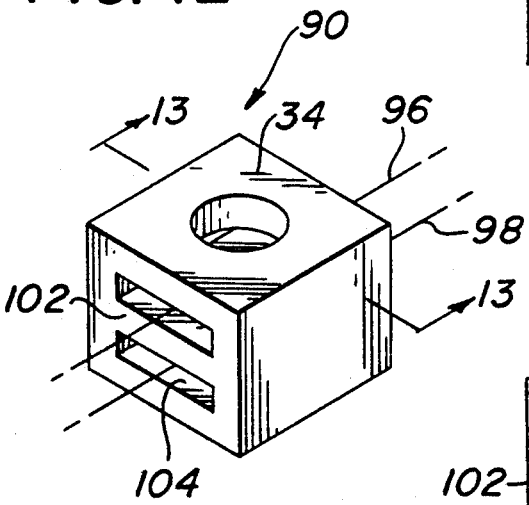
FIG. 12 is an isometric view illustrating one embodiment of a post terminal encompassed by the present invention, useful, for example, for supporting the lower end of a support post.
Figure 13:
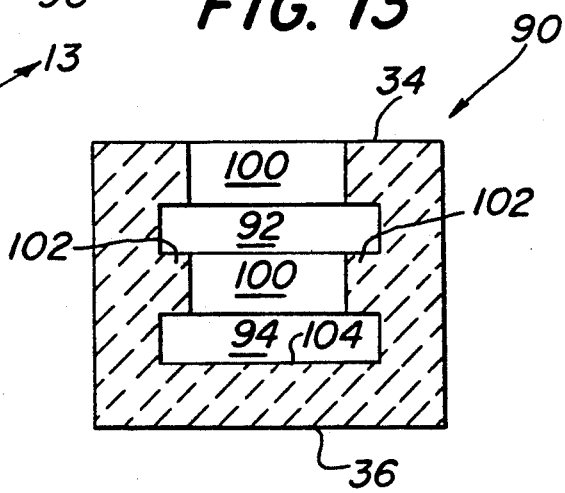
FIG. 13 is a cross-sectional view of the post terminal illustrated in FIG. 12, taken along line 13—13.

FIGS. 12 and 13 illustrate even a further embodiment of a post terminal encompassed by the present invention. The post terminal illustrated in FIGS. 12 and 13 is generally represented by reference numeral 90.

Post terminal 90 comprises at least two parallel faces 34 and 36. Post terminal 90 also defines at least two polygonally-shaped cavities 92 and 94 passing therethrough. The longitudinal axes 96 and 98 of cavities 92 and 94, respectively, are generally parallel to post terminal parallel faces 34 and 36.

Post terminal 90 further defines at least one hole 100 therein. A first portion of hole 100 passes through post terminal parallel face 34 and opens into cavity 92. A second portion of hole 100 also passes through post terminal medial wall portion 102 and opens into cavity 94. Hole 100, however, does not pass through opposing post terminal parallel face 36.

In practice, one end of a support post passes through the first portion hole 100, into cavity 92. The support post end then passes through the second portion of hole 100, into cavity 94. The support post end finally abuts post terminal inside wall surface 104 defined by cavity 94.

Post terminal 90 can be employed as either an anchoring means for the lower end of a support post or as a supporting means upon which deck plates and/or support beams can rest. In either instance, this particular design affords greater stability and strength.

Figure 18:
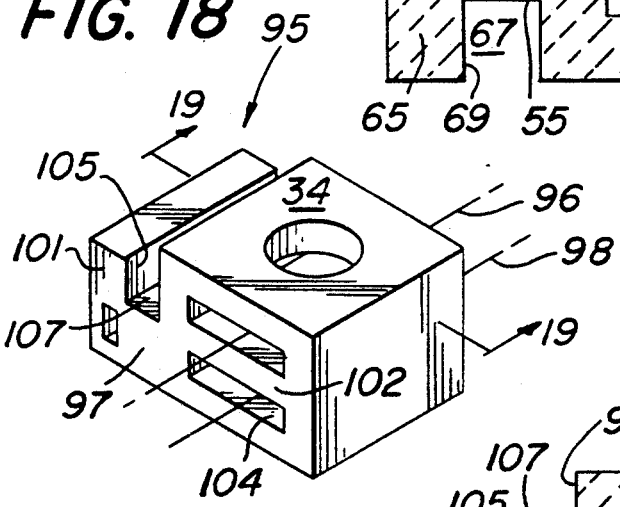
FIG. 18 is an isometric view illustrating one embodiment of a post terminal encompassed by the present invention useful, for example, for supporting the lower end of a support post, while including means for anchoring vertically-oriented retaining walls.
Figure 19:
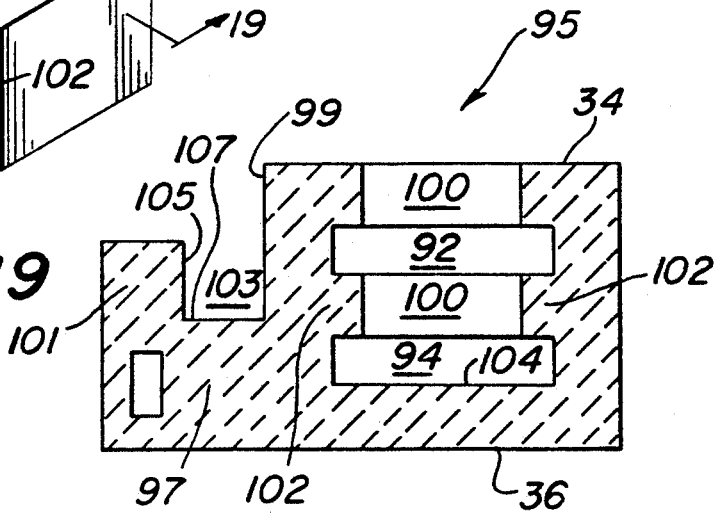
FIG. 19 is a cross-sectional view of the post terminal illustrated in FIG. 18, taken along line 19—19.

Post terminal 90 can be adapted to include outwardly protruding ledge portion(s) either alone or in conjunction with an upwardly-extending or downwardly-extending hook portion(s) (see, for example, FIGS. 18 and 19).

Figure 14:
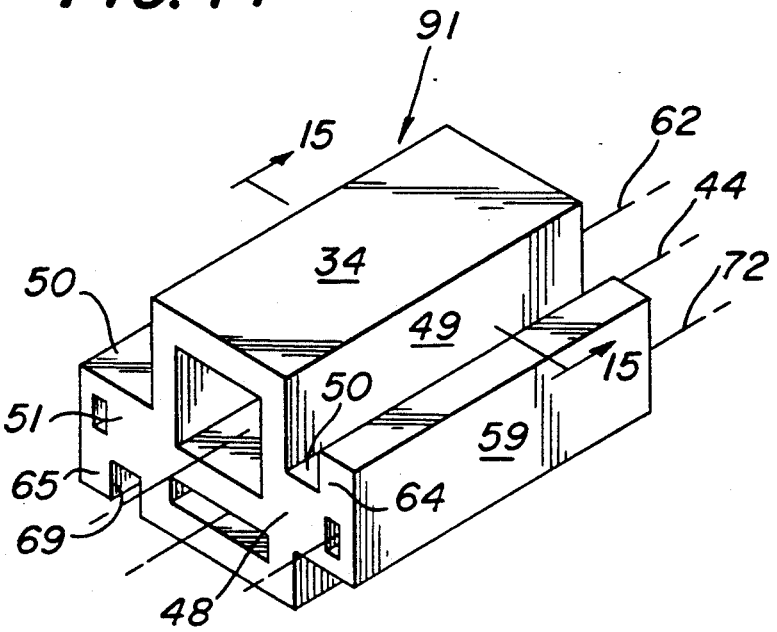
FIG. 14 is an isometric view illustrating one embodiment of a post terminal encompassed by the present invention, including means for minimizing shifting and/or buckling of deck plates and/or support beams positioned thereon, and including means for anchoring vertically-oriented retaining walls.
Figure 15:
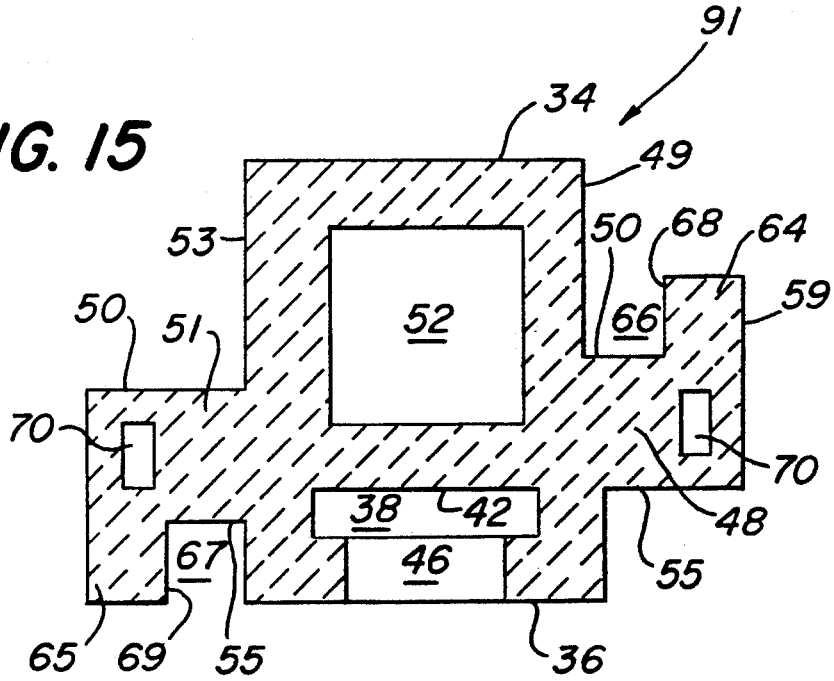
FIG. 15 is a cross-sectional view of the post terminal illustrated in FIG. 14, taken along line 15—15.

FIGS. 14 and 15 illustrate yet a further embodiment of a post terminal encompassed by the present invention. The post terminal illustrated in FIGS. 14 and 15 is generally represented by reference numeral 91.

Post terminal 91 comprises a means for minimizing the shifting and/or buckling of deck plates and/or support beams positioned thereon, and means for anchoring a vertically-oriented retaining wall useful, for example, for confining the fibrous insulating material to the kiln car chassis.

Post terminal 91 comprises at least two parallel faces 34 and 36. Post terminal 91 also defines at least one polygonally-shaped cavity 38 passing therethrough.

The longitudinal axis 44 of cavity 38 is generally parallel to post terminal parallel faces 34 and 36. Moreover, post terminal 91 also defines at least one hole 46 which, while passing through post terminal parallel face 36, does not pass through opposing post terminal parallel face 34.

Post terminal 91 also comprises ledge portions 48 and 51 protruding outwardly from post terminal outside wall surfaces 49 and 53, respectively. Moreover, post terminal 91 also comprises: (a) hook portion 64 extending upwardly from ledge portion 48 and spaced laterally from post terminal outside wall surface 49, and (b) claw portion 65 extending downwardly from ledge portion 51 and spaced laterally from post terminal outside wall surface 53.

Post terminal 91 has two longitudinally-oriented channels 66 and 67 defined therein. Channel 66 is defined by hook portion 64 inside wall surface 68, ledge portion 48 upper wall surface 50 and post terminal outside wall surface 49. Channel 67 is defined by claw portion 65 inside wall surface 69, ledge portion 51 lower wall surface 55 and post terminal outside wall surface 53.

In practice, the upper end of a support post passes through hole 46 and abuts opposing post terminal inside wall surface 42 defined by cavity 38. Deck plates and/or support beams comprising corresponding claw portions extending downwardly therefrom are interlocked with post terminal 91 by having the downwardly-extending claw portions fit into channel 66.

A vertically-oriented retaining wall is then positioned in place. Claw portion 65 is used to anchor the retaining wall in a generally vertical position. Preferably, the upper end of a retaining wall is designed to include a hook portion extending upwardly therefrom. More preferably, this hook portion is dimensioned to fit within channel 67. One embodiment of anchoring a retaining wall by post terminal 91 is illustrated in FIG. 20 which will be discussed later.

Figure 16:
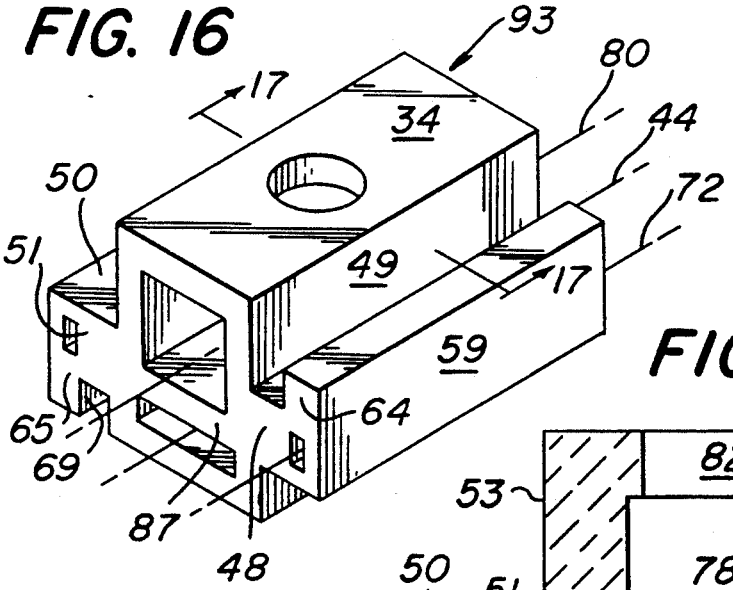
FIG. 16 is an isometric view illustrating one embodiment of a post terminal encompassed by the present invention, including means for minimizing the shifting and/or buckling of deck plates and/or support beams positioned thereon, and including means for coupling together two support posts.
Figure 17:
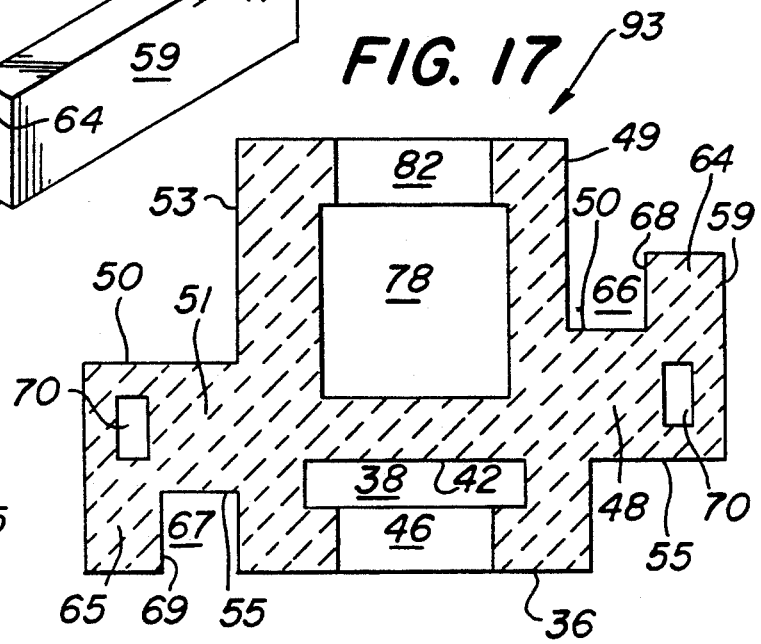
FIG. 17 is a cross-sectional view of the post terminal illustrated in FIG. 16, taken along line 17—17.
Figure 21:
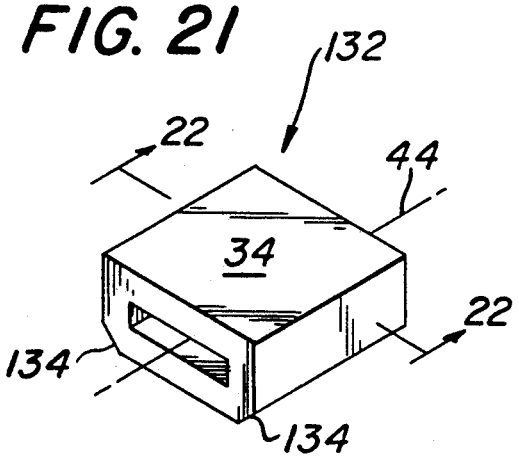
FIG. 21 is an isometric view illustrating one embodiment of a streamlined post terminal encompassed by the present invention.

FIGS. 16 and 17 illustrate yet a further embodiment of a post terminal encompassed by the present invention. The post terminal illustrated in FIGS. 20 and 21 is generally represented by reference numeral 93.

Post terminal 93 comprises some of the features of post terminal 91 (i.e., FIGS. 14 and 15) and post terminal 76 (i.e., FIGS. 6 and 7). Specifically, as does post terminal 91, post terminal 93 also comprises at least two parallel faces 34 and 36. Post terminal 93 also defines at least one polygonally-shaped cavity 38 passing therethrough. The longitudinal axis 44 of cavity 38 is generally parallel to post terminal parallel faces 34 and 36. Moreover, post terminal 93 also defines at least one hole 46 which, while passing through post terminal parallel face 36, does not pass through opposing post terminal parallel face 34.

Post terminal 93 also comprises ledge portions 48 and 51 protruding outwardly from post terminal outside wall surfaces 49 and 53, respectively. Moreover, post terminal 93 also comprises hook portion 64 spaced laterally from post terminal outside wall surface 49 and extending upwardly from ledge portion 48, thus defining channel 66, and claw portion 65 spaced laterally from post terminal outside wall surface 53 and extending downwardly from ledge portion 51, thus defining channel 67.

On the other hand, as with post terminal 76 (i.e., FIGS. 6 and 7), post terminal 93 defines a second polygonally-shaped cavity 78 passing therethrough. The longitudinal axis 80 of cavity 78 is generally parallel to that of cavity 38 and to the two post terminal parallel faces 34 and 36. Moreover, post terminal 93 also defines a second hole 82 which, while passing through parallel face 34, does not pass through opposing parallel face 36.

In practice, post terminal 93 can be employed for the same purposes as post terminal 91 (i.e., FIGS. 14 and 15), while simultaneously being employed as a coupling means between two support posts.

FIGS. 18 and 19 illustrate yet another embodiment of a post terminal encompassed by the present invention. The post terminal illustrated in FIGS. 18 and 19 is generally represented by reference numeral 95.

Post terminal 95 is an embodiment of a post terminal similar to that illustrated in FIGS. 12 and 13 (i.e., post terminal 90) but further comprising a means for anchoring a vertically-oriented retaining wall. Specifically, as does post terminal 90, post terminal 95 comprises at least two parallel faces 34 and 36. Post terminal 95 also defines at least two polygonally-shaped cavities 92 and 94 passing therethrough. The longitudinal axes 96 and 98 of cavities 92 and 94, respectively, are generally parallel to post terminal faces 34 and 36.

Post terminal 95 also defines at least one hole 100 therein. A first portion of hole 100 passes through post terminal parallel face 34 and opens into cavity 92. A second portion of hole 100 passes through post terminal medial wall portion 102 and opens into cavity 94. Hole 100, however, does not pass through opposing post terminal parallel face 36.

Post terminal 95 further comprises ledge portion 97 protruding outwardly from post terminal outside wall surface 99. Moreover, post terminal 95 also comprises hook portion 101 extending upwardly from ledge 97 and spaced laterally from post terminal outside wall surface 99.

Post terminal 95 also defines therein channel 103. Channel 103 is defined by hook portion 101 inside wall surface 105, ledge 97 upper wall surface 107 and post terminal outside wall surface 99.

Channel 103 makes this embodiment of the present invention especially useful for supporting the lower end portion of a support post, while providing a means for anchoring the lower end portion of a vertically-oriented retaining wall. In practice, the lower end of a support post is supported by having its lower end pass through the first portion of hole 100, into cavity 92. The support post lower end then passes through the second portion of hole 100, into cavity 94 until it finally abuts post terminal inside wall surface 104 defined by cavity 94.

In practice, the lower end of a vertically-oriented retaining wall is anchored into position by having its lower end fitted into post terminal channel 103. Preferably, the lower end portion of the retaining wall is designed to include a claw portion extending downwardly therefrom. More preferably, the claw portion is dimensioned to fit within post terminal channel 103 An illustration of this embodiment of a post terminal in use can be seen in FIG. 20 which will now be discussed.

FIG. 20 illustrates an end, partially sectionalized, elevation view of an improved, multi-tiered kiln car employing post terminals 60, 74, 86, 88, 90, 93 and 95. The improved kiln car illustrated in FIG. 20 is generally represented by reference numeral 106.

Kiln car 106 generally comprises chassis 108. Attached to the lower portion of chassis 108 is a means for implementing the movement of kiln car 106 through a kiln. In FIG. 20, the means by which movement is implemented comprises flanged running wheels 110 and rails 6.

The parallel face 36 of post terminal 95 is placed on the upper surface 112 of chassis 108 along the side perimeters of the kiln car. The parallel face 36 of post terminal 90 is placed on the kiln car upper surface 112 between the side perimeters of the kiln car. A layer of protective insulating material 114 is fitted around post terminals 95 and 90.

The lower end of first level peripheral support post 116 is fitted into the openings defined in post terminal 95 as described earlier. Moreover, the lower end of first level medial support post 117 is fitted into the openings defined in post terminal 90 as described earlier.

The upper portion of first level peripheral support post 116 is then passed through hole 46 defined in post terminal 93 as described earlier. Moreover, the upper end of first level medial support post 117 is then passed through hole 46 defined in post terminal 86 as described earlier.

Vertically-oriented retaining wall 109 is then fitted between post terminals 93 and 95. The upper end of retaining wall 109 comprises hook portion 111, while the lower end of retaining wall 109 comprises claw portion 113. Retaining wall hook portion 111 and claw portion 113 are dimensioned to fit within channels 67 and 103 (not shown) defined partially by post terminal 93 claw portion 65 and post terminal 95 hook portion 101, respectively.

After retaining wall 109 has been fitted into place, conventional insulating material 118 is positioned on protective layer 114 and fitted between opposing retaining walls inside wall surfaces 115.

The bed of insulating material 118 can, optionally, be covered by first level deck plates 119. First level deck plates 119 have claw portions 12 extending downwardly from the deck plates' lower surface. Claw portions 121 are positioned and dimensioned such that they fit into channels 66 (not shown) of post terminals 93 and 86 defined, in part, by post terminals' hook portions 64. By practicing this procedure, a base level of kiln car 106 is completed. It should be noted, however, that this base level is optional. In some instances, the particular user may wish to employ either the retaining walls 109, or the first level deck plates 119, or both or neither.

A user may also wish to stop manufacturing the kiln car at this particular point. However, if a user wishes to employ a multi-tiered kiln car, the novel post terminals of the present invention can be implemented to satisfy this desire. Specifically, on the sides of kiln car 106, the lower end portion of a second level support post 122 is passed through hole 82 of post terminal 93 also as described earlier. Wall portion 87 of post terminal 93 separates the upper end of first level support post 116 from the lower end of second level support post 122.

For the posts positioned between the sides of kiln car 106, the lower end of a second level support post 123 is passed through hole 82 of post terminal 86 as described earlier. Wall portion 87 of post terminal 86 separates the upper end of first level support post 117 from the lower end of second support post 123.

The upper end portion of second support post 122 then passes through hole 46 defined in second level side post terminal 88. Similarly, the upper end portion of second support post 123 passes through hole 46 (not shown) defined in a second level medial post terminal. Since this second level medial post terminal is the same as post terminal 86, the second level medial post terminal is referred to by the same reference numeral (i.e., 86).

Second level deck plates 124 are held suspended above first level deck plates 119 by second level post terminals 86 and 88. Specifically, second level deck plates 124 have claw portions 126 extended downwardly from the deck plates' lower surface. Claw portions 126 are positioned and dimensioned such that they fit into channel 66 defined, in part, by second level post terminals' hook portions 64. By practicing this procedure, the first tier of kiln car 106 can be completed. The amount of shifting and/or buckling of deck plates 124 will be substantially minimized due to the novel hook and claw design of the present invention.

To construct the second tier of kiln car 106, the lower end portion of a third level support post 128, positioned on the sides of kiln car 106, passes through hole 82 of second level, side post terminal 88 as described earlier. Similarly, the lower end portion of a third level support post 130, positioned between the sides of kiln car 106, passes through hole 82 (not shown) of second level medial post terminal 86, also as described earlier.

The upper end portion of third level support posts 128 passes through hole 46 defined in a third level, side post terminal 74; and the upper end portion of third level support post 130 passes through hole 46 (not shown) of third level medial post terminal 60, both as described earlier.

Third level deck plates 131 are suspended above first and second level deck plates 119 and 124 by third level post terminals 74 and 60. Third level deck plates 131 also comprise claw portions 126 extruding downwardly from their lower surface. Claw portions 126 of third level deck plates 131 are also positioned and dimensioned such that they fit within channels 66 defined, in part, by third level post terminals' hook portions 64.

If additional levels are desired, third level post terminals 60 and 74 can be replaced by third level post terminals 86 and 88, respectively. This process can continue until a kiln car is produced with the desired numbers of tiers.

Moreover, as also disclosed earlier, post terminals 88 and 74 can also be replaced by post terminals 86 and 60, respectively. Then, a sealing means can be fitted into channel 66 which does not have a deck plate claw portion fitted therein. This sealing means can be dimensioned such that its surfaces and edges are in close relationship with the inside side wall surface of a kiln.

Figure 22:
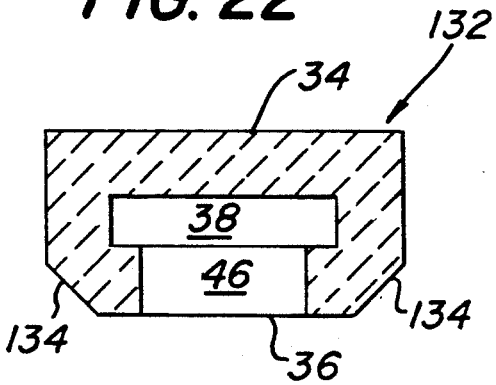
FIG. 22 is a cross-sectional view of the post terminal illustrated in FIG. 21, taken along line 22—22.

FIGS. 21 and 22 illustrate even further embodiments of post terminals encompassed by the present invention. The post terminal illustrated in FIGS. 21 and 22 is generally represented by reference numeral 132.

As can be seen, post terminal 132 comprises at least two parallel faces 34 and 36. Post terminal 132 also defines at least one polygonally-shaped cavity 38 passing therethrough. The longitudinal axis 44 of cavity 38 is generally parallel to post terminal parallel faces 34 and 36. Moreover, post terminal 132 also defines at least one hole 46 which, while passing through post terminal parallel face 36, does not pass through opposing post terminal parallel face 34.

Post terminal 132 also comprises angled, horizontally-oriented, side wall portions 134. Due to the streamlined shaped of post terminal 132, combustion streams inside a kiln are less hindered.

Figure 23:
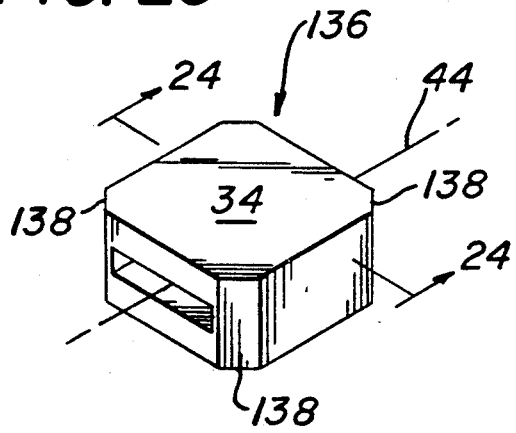
FIG. 23 is an isometric view illustrating one embodiment of a streamlined post terminal encompassed by the present invention.
Figure 24:
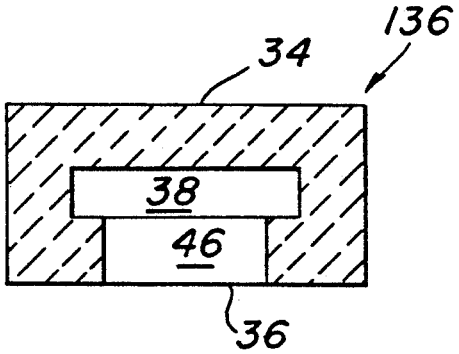
FIG. 24 is a cross-sectional view of the post terminal illustrated in FIG. 23, taken along line 24—24.

FIGS. 23 and 24 illustrate another method of a streamlined post terminal encompassed by the present invention. The streamlined post terminal illustrated in FIGS. 23 and 24 is generally represented by reference numeral 136.

Post terminal 136 comprises at least two parallel faces 34 and 36. Post terminal 136 also defines at least one polygonally-shaped cavity 38 passing therethrough. The longitudinal axis 44 of cavity 38 is generally parallel to post terminal parallel faces 34 and 36. Moreover, post terminal 136 also defines at least one hole 46 which, while passing through post terminal parallel face 36, does not pass through opposing post terminal parallel face 34.

Post terminal 136 is streamlined due to the presence of angled, vertically-oriented, side wall portions 138. As do horizontally-oriented angled side wall portions 134 of post terminal 132, vertically-oriented, angled side wall portions 138 of post terminal 136 also decrease the amount of resistance to combustion gasses flowing through and around the kiln car during typical kiln-firing processes.

As can be expected, any post terminal encompassed by the present invention can be streamlined by any suitable manner. For example, it is within the scope of this invention to have a post terminal streamlined by the implementation of vertically-oriented angled wall portions 138, horizontally-oriented angled wall portions 134, or any combination thereof.

FIGS. 25–30 illustrate other embodiments of post terminals encompassed by the present invention. These embodiments include means for minimizing the shifting and/or buckling of deck plates and/or support beams when the same are subjected to the normal physical and thermal shocks encountered in typical kiln-firing processes. These various examples of means for minimizing shifting and/or buckling will now be discussed.

Figure 25:
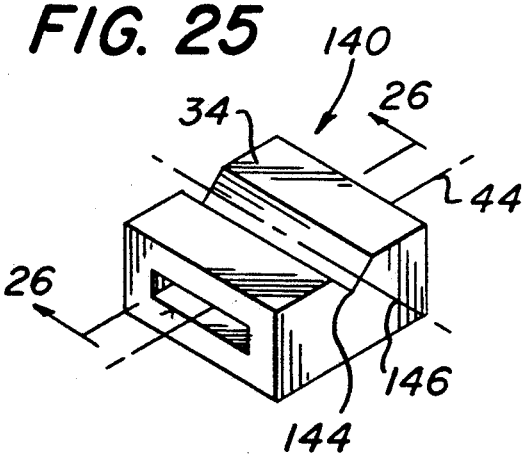
FIG. 25 is an isometric view illustrating one embodiment of a post terminal encompassed by the present invention, including means for minimizing the shifting and/or buckling of deck plates and/or support beams positioned thereon.
Figure 26:
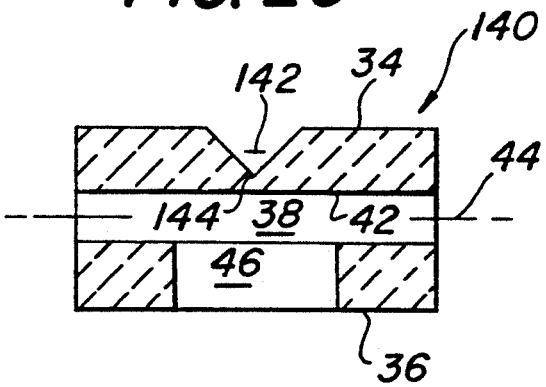
FIG. 26 is a cross-sectional view of the post terminal illustrated in FIG. 25 taken along line 26—26.

The post terminal illustrated in FIGS. 25 and 26 is generally represented by reference numeral 140. Post terminal 140 comprises at least two parallel faces 34 and 36. Post terminal 140 also defines at least one polygonally-shaped cavity 38 passing therethrough. The longitudinal axis 44 of cavity 38 is generally parallel to post terminal parallel faces 34 and 36. Moreover, post terminal 140 also defines at least one hole 46 which, while passing through post terminal parallel face 36, does not pass through opposing post terminal parallel face 34.

Post terminal 140 also defines a V-shaped channel 142 positioned in post terminal parallel face 34. The lowermost portion 144 of channel 142 must be a sufficient distance above post terminal inside wall surface 42 defined by cavity 38. Specifically, the distance between the lowermost portion 144 of channel 142 and post terminal inside wall surface 42 must be sufficient to provide enough strength to post terminal 140 to enable the post terminal to withstand most of the normal physical and thermal shocks encountered in typical kiln-firing processes. Generally, this distance should be at least about one quarter of an inch. Preferably, this distance ranges from between about one quarter of an inch and about six inches, more preferably, from between about three eighths of an inch and about five inches, and even more preferably, from between about one half of an inch and about four inches.

In practice, a deck plate and/or support beam is manufactured having, on its lower surface, a downwardly extending rib (not shown) which corresponds with channel 142 of post terminal 140. By fitting the downwardly extending rib from the deck plate and/or the support beam into corresponding channel 142, the amount of shifting and/or buckling encountered thereby, when the same is subjected to typical kiln-firing conditions, will be substantially minimized.

It is presently preferred to have the longitudinal axis 146 of channel 142 generally parallel to post terminal parallel faces 34 and 36, and generally perpendicular to longitudinal axis 44 of cavity 38.

Figure 27:
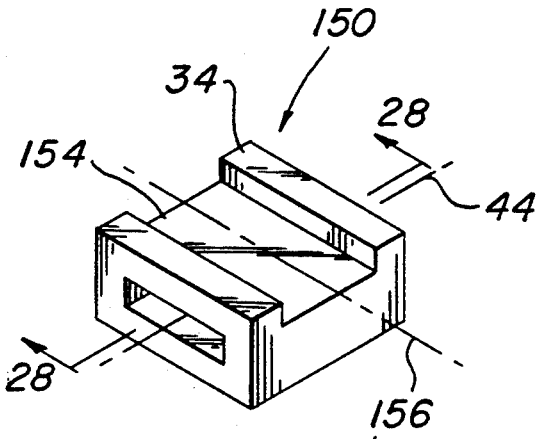
FIG. 27 is an isometric view illustrating one embodiment of a post terminal encompassed by the present invention, including means for minimizing the shifting and/or buckling of deck plates and/or support beams positioned thereon.
Figure 28:
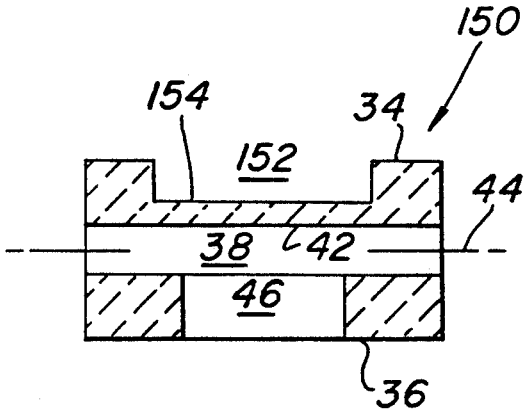
FIG. 28 is a cross-sectional view of a post terminal illustrated in FIG. 27, taken along line 28—28.

The post terminal illustrated in FIGS. 27 and 28 is generally represented by reference numeral 150. Post terminal 150 is similar to post terminal 140 in that it comprises at least two parallel faces 34 and 36. Post terminal 150 also defines at least one polygonally-shaped cavity 38 passing therethrough. The longitudinal axis 44 of cavity 38 is generally parallel to post terminal parallel faces 34 and 36. Moreover, post terminal 150 also defines at least one hole 46 which, while passing through post terminal face 36, does not pass through opposing post terminal face 34.

Post terminal 150 differs from post terminal 140 in that post terminal 150 defines a U-shaped channel 152 positioned in its parallel face 34. Wall surface 154 defined by channel 152 must be a sufficient distance above post terminal inside wall surface 42 defined by cavity 38 to afford sufficient strength.

As stated before, the distance between wall surface 154 of channel 152 and post terminal inside wall surface 42 must be sufficient to provide enough strength to post terminal 150 to enable it to withstand much of the normal physical and thermal shocks encountered in typical kiln-firing processes. Generally, the distance should be at least about one quarter of an inch. Preferably, the distance ranges from between about one quarter of an inch and about six inches, more preferably, between about three eighths of an inch and about five inches, and even more preferably, from between about one half of an inch and four inches. In practice, a deck plate and/or support beam is manufactured having, on its lower surface, a downwardly-extending claw portion (not shown) which corresponds with channel 152 of post terminal 150. By fitting the downwardly-extending claw portion from the deck plate and/or the support beam into corresponding channel 152, the amount of shifting and/or buckling encountered thereby, when the same is subjected to typical kiln-firing conditions, will be substantially minimized.

In addition to the above, post terminal 150 can be employed to couple together two adjacent deck plates and/or support beams. In this instance, each deck plate and/or support beam comprises a downwardly-extending claw portion. The total width of the claw portions of the adjacent deck plates and/or support beams is such that they can both fit within channel 152 at the same time.

As with post terminal 140, in post terminal 150 it is also presently preferred to have the longitudinal axis 156 of channel 152 generally parallel to post terminal parallel faces 34 and 36, and generally perpendicular to longitudinal axis 44 of cavity 38.

Figure 29:
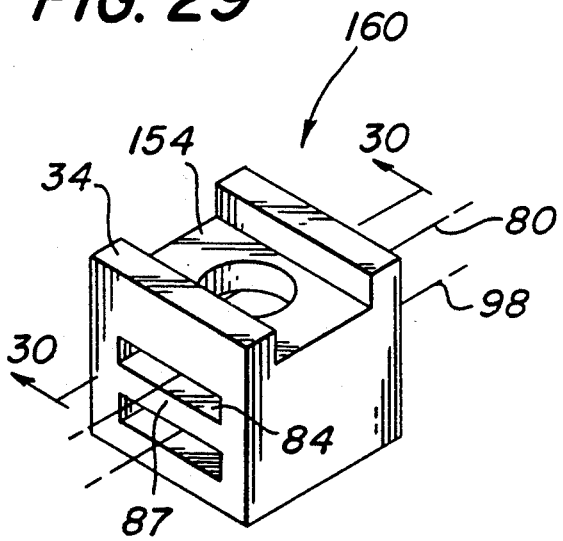
FIG. 29 is an isometric view illustrating one embodiment of a post terminal encompassed by the present invention, useful, for example, for coupling together a plurality of support posts, while including means for minimizing the shifting and/or buckling of deck plates and/or support beams positioned thereon.
Figure 30:
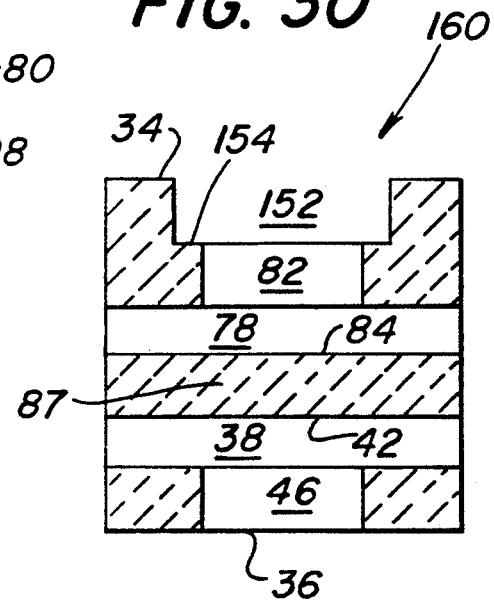
FIG. 30 is a cross-sectional view of the post terminal illustrated in FIG. 29, taken along line 30—30.

The post terminal illustrated in FIGS. 29 and 30 is generally represented by reference numeral 160. Post terminal 160 combines features from post terminal 76 (i.e., FIGS. 6 and 7) and post terminal 150 (i.e., FIGS. 27 and 28).

Specifically, post terminal 160 comprises at least two parallel faces 34 and 36. Post terminal 160 also defines at least one polygonally-shaped cavity 38 passing therethrough. The longitudinal axis 98 of cavity 38 is generally parallel to post terminal parallel faces 34 and 36. Moreover, post terminal 160 also defines at least one hole 46 which, while passing through post terminal parallel face 36, does not pass through opposing post terminal parallel face 34.

As with post terminal 76 (i.e., FIGS. 6 and 7), post terminal 160 defines a second polygonally-shaped cavity 78 passing therethrough. The longitudinal axis 80 of cavity 78 is generally parallel to that of cavity 38 and to the two post terminal parallel face 34 and 36.

On the other hand, as with post terminal 150 (i.e., FIGS. 27 and 28), post terminal 160 defines a U-shaped channel 152 in post terminal parallel face 34. The wall surface 154 defined by channel 150 has a hole 82 defined therein. Hole 82 passes through wall surface 154 and opens into cavity 78. Hole 82 does not, however, pass completely through opposing post terminal parallel face 36.

Post terminal 160 also comprises wall portion 87 located between cavities 38 and 78. The presence of wall portion 87 prevents: (a) hole 46 from passing through opposing post terminal parallel face 34 and (b) hole 82 from passing through opposing post terminal parallel face 36.

In practice, the upper end of a first support post passes through hole 46 and abuts opposing post terminal inside wall surface 42 defined by cavity 38. Then, the lower end of a second support post passes through hole 82 and abuts post terminal inside wall surface 84 defined by cavity 78.

Deck plates and/or support beams, having downwardly extending claw portions, can have these claw portions fitted into channel 152. The claw portions, preferably, are dimensioned to fit within channel 152 and around the second post terminal portion passing upwardly through hole 82.

FIGS. 1–30 merely illustrate possible embodiments of post terminals encompassed by the present invention. As long as a post terminal defines at least one polygonally-shaped cavity passing therethrough and at least one hole which passes through the post terminal outside wall surface and opens into the at least one polygonally-shaped cavity but does not pass completely through the opposing post terminal outside wall surface, such a post terminal is encompassed by the present invention. The implementation of the post terminals disclosed herein result in an improved kiln car.

The post terminal of the present invention has a greater endurance to the normal physical and/or thermal shocks encountered in typical kiln-firing processes. Specifically, due to the presence of the at least one polygonally-shaped cavity passing therethrough, the overall vertical thickness of the novel post terminal side wall portions can be substantially greater than that of conventional post terminals, without significantly increasing the amount of heat absorption. Therefore, the post terminals of the present invention will be a welcomed improvement in the kiln car industry since they have greater endurance to the normal physical thermal shocks encountered in typical kiln-firing processes, while absorbing approximately the same amount of heat as do their weaker, conventional counterparts.

Post terminals encompassed by the present invention can be manufactured by any suitable means known to those skilled in the art. Examples of such suitable means include, but are not limited to: molding, casting and extruding. The preferred method of production depends largely upon the resources and facilities available to the particular manufacturer.

If a casting or molding method of production is employed, the post terminal can be manufactured in either a one-step, or a two-step, process. In one example of a suitable one-step process, the post terminal is molded/cast with the at least one polygonally-shaped cavity passing therethrough and the corresponding at least one hole passing through the post terminal outside wall surface and opening into the cavity.

In one example of a two-step process, the post terminal is fabricated with only the at least one polygonally-shaped cavity passing therethrough in its desired location. Thereafter, the at least one hole, passing through the post terminal outside wall surface, is cut or drilled such that the hole opens into the polygonally-shaped cavity.

If such a two-step process is practiced, it is presently preferred to employ a back stop means. This back stop means preferably has a shape which corresponds with the dimensions of the at least one polygonally-shaped cavity.

In the preferred practice, prior to the cutting/drilling of the at least one hole through the post terminal outside wall surface, the back stop means is fitted within the polygonally-shaped cavity. Thereafter, the hole is cut/drilled. This process greatly simplifies the second, hole-making step.

If the method selected for producing post terminals in accordance with the present invention is by extrusion, the two-step process must be employed.

The composition of the post terminals made in accordance with the present invention depends, in part, on the specific conditions encountered by the particular kiln in which the kiln car will be employed. The post terminals encompassed by the present invention can be made from any suitable material. Examples of suitable materials include, but are not limited to: refractory materials (e.g., pyrophyllite-andalusite, fire clay, bauxite, cordierite, etc.), clay, silica, concrete, terra cotta, polymeric materials, brick, and the like, and/or any combination thereof. While the preferred construction material depends largely on the specific physical and thermal conditions of the particular kiln in which the kiln car will be employed, in typical kiln-firing processes, it is presently preferred to construct the post terminals from refractory-type materials.

It is evident from the foregoing that various modifications can be made to embodiments of this invention without departing from the spirit and scope thereof, which will be apparent to those skilled in the art. Having thus described the invention, it is claimed as follows.

That which is claimed is:

1. A polyhedronal post terminal defining at least a first polygonally-shaped cavity passing completely therethrough and at least a first hole passing through one of said post terminal's outside wall surfaces and opening into said first polygonally-shaped cavity, said first hole does not pass through the opposing post terminal outside wall surface which is aligned with, and opposes, said post terminal outside wall surface having said first hole passing therethrough, said post terminal comprises:

(a) a first face and a second face which are generally aligned with, and parallel to, one another, wherein:
  (i) the longitudinal axis of said first polygonally-shaped cavity is generally parallel to said first and second faces, and
  (ii) said first hole passes through only one of said first or second faces;

(b) a first post terminal side wall surface which is angularly oriented to said first and second post terminal faces, said angular orientation ranges from between about 30° to about 150°;

(c) a first ledge portion protruding outwardly from said first post terminal side wall surface, said first ledge portion having an upper surface which is angularly oriented to said first post terminal side wall surface, and said angular orientation ranges from between about 45° to about 135°; and (d) a first hook portion extending upwardly from said first ledge portion, said first hook portion having an inside wall surface which is:

(i) angularly oriented to said first ledge portion upper surface, said angular orientation ranging from between about 45° to about 135°, and (ii) spaced laterally from said first post terminal side wall surface such that a channel is defined between said first post terminal side wall surface, said first ledge portion upper surface, and said first hook portion inside wall surface.

2. A post terminal as recited in claim 1 wherein the distance between any inside wall surface defined by said first polygonally-shaped cavity and any of said post terminal outside wall surface is such that said post terminal has sufficient strength to withstand a majority of the normal physical and thermal shocks encountered in typical kiln-firing processes.

3. A post terminal as recited in claim 2 wherein said distance between any of said post terminal inside wall surfaces defined by said first cavity and any of said post terminal outside wall surfaces is at least about one quarter of an inch.

4. A post terminal as recited in claim 3 wherein said distance between any of said post terminal inside wall surfaces defined by said first cavity and any of said post terminal outside wall surface ranges from between about one quarter of an inch and about six inches.

5. A post terminal as recited in claim 4 wherein said distance between any of said post terminal inside wall surfaces defined by said first cavity and any of said post terminal outside wall surfaces ranges from between about three eighths of an inch and about five inches.

6. A post terminal as recited in claim 5 wherein said distance between any of said post terminal inside wall surfaces defined by said first cavity and any of said post terminal outside wall surfaces ranges between about one-half of an inch and about four inches.

7. A post terminal as recited in claim 1 wherein said first hole is dimensioned to receive an end portion of a corresponding support post.

8. A post terminal as recited in claim 1 wherein said polyhedronal configuration is selected from the group consisting of: triangular, tetragonal, square, rectangular, pentagonal, hexagonal, heptagonal, octagonal and cylindrical.

9. A post terminal as recited in claim 1 wherein said first polygonally-shaped cavity has a configuration selected from the group consisting of: triangular, tetragonal, square, rectangular, pentagonal, hexagonal, heptagonal, octagonal and cylindrical.

10. A post terminal as recited in claim 1 wherein the vertical distance between the upper surface of said first ledge portion and the lower surface of said first ledge portion is sufficient to support the weight of articles positioned thereon during typical kiln-firing processes.

11. A post terminal as recited in claim 10 wherein the vertical distance between said first ledge portion upper surface and said first ledge portion lower surface is at least about one half of an inch.

12. A post terminal as recited in claim 11 wherein the vertical distance between said first ledge portion upper surface and said first ledge portion lower surface ranges from between about one half of an inch and about six inches.

13. A post terminal as recited in claim 12 wherein the vertical distance between said first ledge portion upper surface and said first ledge portion lower surface ranges from between about five eighths of an inch and about five inches.

14. A post terminal as recited in claim 13 wherein the vertical distance between said first ledge portion upper surface and said first ledge portion lower surface ranges from between about three quarters of an inch and about four inches.

15. A post terminal as recited in claim 1 wherein said first post terminal face is the lower surface of said post terminal and said second post terminal face is the upper surface of said post terminal, and wherein the vertical distance between said first ledge portion upper surface and said post terminal upper surface is such that, when a deck plate or a support beam is positioned onto said first ledge portion upper surface, the upper surface of said deck plate or said support beam corresponds with said post terminal upper surface.

16. A post terminal as recited in claim 1 wherein the horizontal distance between said first hook portion inside wall surface and said first hook portion outside wall surface is at least about one half of an inch.

17. A post terminal as recited in claim 16 wherein said horizontal distance between said first hook portion inside wall surface and said first hook portion outside wall surface ranges from between about one half of an inch and about six inches.

18. A post terminal as recited in claim 17 wherein said horizontal distance between said first hook portion inside wall surface and said first hook portion outside wall surface ranges from between about five eighths of an inch and about five inches.

19. A post terminal as recited in claim 18 wherein said horizontal distance between said first hook portion inside wall surface and said first hook portion outside wall surface ranges from between about three quarters of an inch and about four inches.

20. A post terminal as recited in claim 1, wherein said post terminal further comprises:

(a) a second post terminal side wall surface which is angularly oriented to said first and second post terminal faces, said angular orientation ranges from between about 30° to about 150°; and (b) a second ledge portion protruding outwardly from said second post terminal side wall surface.

21. A post terminal as recited in claim 20, wherein said second ledge portion has an upper surface which is angularly oriented to said second post terminal side wall surface, and wherein said angular orientation ranges from between about 45° to about 135°, said post terminal further comprising:

(a) a second hook portion extending upwardly said second ledge portion, said second hook having an inside wall surface which is:

(i) angularly oriented to said second ledge portion upper surface, said angular orientation ranging from between about 45° to about 135°, and (ii) spaced laterally from said second post terminal side wall surface such that a channel is defined between said second post terminal side wall surface, said second ledge portion upper surface, and said second hook portion inside wall surface.

22. A post terminal as recited in claim 20, wherein said second ledge portion has a lower surface which is angularly oriented to said second post terminal side wall surface, and wherein said angular orientation ranges from between about 45° to about 135°, said post terminal further comprising:

(a) a first claw portion extending downwardly from said second ledge portion, said first claw portion having an inside wall surface which is:
  (i) angularly oriented to said second ledge portion lower surface, said angular orientation ranging from between about 45° to about 135°, and
  (ii) spaced laterally from said second post terminal side wall surface such that a channel is defined between said second post terminal side wall surface, said second ledge portion lower surface, and said first claw portion inside wall surface.

23. A post terminal as recited in claim 1 further defining:

(a) at least a second polygonally-shaped cavity passing therethrough wherein the longitudinal axis of said second polygonally-shaped cavity is generally parallel to said longitudinal axis of said first polygonally-shaped cavity, and
(b) at least a second hole passing through said second post terminal face, wherein the longitudinal axis of said second hole is:
  (i) generally parallel to said longitudinal axis of said first hole, and
  (ii) generally perpendicular to said longitudinal axis of said second polygonally-shaped cavity, said second hole does not pass through said opposing first post terminal face.

24. A post terminal as recited in claim 23 further comprising:

(a) a second post terminal side wall surface which is angularly oriented to said first and second post terminal faces, said angular orientation ranges from between about 30° to about 150°; and
(b) a second ledge portion protruding outwardly from said second post terminal side wall surface.

25. A post terminal as recited in claim 24, wherein said second ledge portion has a lower surface which is angularly oriented to said second post terminal side wall surface, and wherein said angular orientation ranges from between about 45° to about 135°, said post terminal further comprising:

(a) a first claw portion extending downwardly from said second ledge portion, said first claw portion having an inside wall surface which is:
  (i) angularly oriented to said second ledge portion lower surface, said angular orientation ranging from between about 45° to about 135°, and
  (ii) spaced laterally from said second post terminal side wall surface such that a channel is defined between said second post terminal side wall surface, said second ledge portion lower surface, and said first claw portion inside wall surface.

26. A post terminal as recited in claim 24, wherein said second ledge portion has an upper surface which is angularly oriented to said second post terminal side wall surface, and wherein said angular orientation ranges from between about 45° to about 135°, said post terminal further comprising:

(a) a second hook portion extending upwardly from said second ledge portion, said second hook portion having an inside wall surface which is:
  (i) angularly oriented to said second ledge portion upper surface, said angular orientation ranging from between about 45° to about 135°, and
  (ii) spaced laterally from said second post terminal side wall surface such that a channel is defined between said second post terminal side wall surface, said second ledge portion upper surface, and said second hook portion inside wall surface.

27. A post terminal as recited in claim 1 wherein said first polygonally-shaped cavity has a configuration selected from the group consisting of: triangular, tetragonal, square, rectangular, pentagonal, hexagonal, heptagonal, octagonal and cylindrical.

28. A polyhedronal post terminal defining at least a first polygonally-shaped cavity passing completely therethrough and at least a first hole passing through one of said post terminals outside wall surfaces and opening into said first polygonally-shaped cavity, said first hole does not pass through the opposing post terminal outside wall surface which is aligned with, and opposes, said post terminal outside wall surface having said first hole passing therethrough, said post terminal comprises:

(a) a first face and a second face which are generally aligned with one another, wherein:
  (i) the longitudinal axis of said first polygonally-shaped cavity is generally parallel to said first and second faces, and
  (ii) said first hole passes through only one of said first or second faces;
(b) a first post terminal side wall surface which is angularly oriented to said first and second post terminal faces, said angular orientation ranges from between about 30° to about 150°;
(c) a first ledge portion protruding outwardly from said first post terminal side wall surface, said first ledge portion having an upper surface which is angularly oriented to said first post terminal side wall surface, and said angular orientation ranges from between about 45° to about 135°; and
(d) a first claw portion extending downwardly from said first ledge portion, said first claw portion having an inside wall surface which is:
  (i) angularly oriented to said first ledge portion lower surface, said angular orientation ranging from between about 45° to about 135°, and
  (ii) spaced laterally from said first post terminal side wall surface such that a channel is defined between said first post terminal side wall surface, said first ledge portion lower surface, and said first claw portion inside wall surface.

29. A post terminal as recited in claim 28 wherein the distance between any inside wall surface defined by said first polygonally-shaped cavity and any of said post terminal outside wall surface is such that said post terminal has sufficient strength to withstand a majority of the normal physical and thermal shocks encountered in typical kiln-firing processes.

30. A post terminal as recited in claim 29 wherein said distance between any of said post terminal inside wall surfaces defined by said first cavity and any of said post terminal outside wall surfaces is at least about one quarter of an inch.

31. A post terminal as recited in claim 30 wherein said distance between any of said post terminal inside wall surfaces defined by said first cavity and any of said post terminal outside wall surface ranges from between about one quarter of an inch and about six inches.

32. A post terminal as recited in claim 31 wherein said distance between any of said post terminal inside wall surfaces defined by said first cavity and any of said post terminal outside wall surfaces ranges from between about three eighths of an inch and about five inches.

33. A post terminal as recited in claim 32 wherein said distance between any of said post terminal inside wall surfaces defined by said first cavity and any of said post terminal outside wall surfaces ranges between about one-half of an inch and about four inches.

34. A post terminal as recited in claim 28 wherein said first hole is dimensioned to receive an end portion of a corresponding support post.

35. A post terminal as recited in claim 28 wherein said polyhedronal configuration is selected from the group consisting of: triangular, tetragonal, square, rectangular, pentagonal, hexagonal, heptagonal, octagonal and cylindrical.

36. A post terminal as recited in claim 28 wherein the vertical distance between the upper surface of said first ledge portion and the lower surface of said first ledge portion is sufficient to support the weight of articles positioned thereon during typical kiln-firing processes.

37. A post terminal as recited in claim 36 wherein the vertical distance between said first ledge portion upper surface and said first ledge portion lower surface is at least about one half of an inch.

38. A post terminal as recited in claim 37 wherein the vertical distance between said first ledge portion upper surface and said first ledge portion lower surface ranges from between about one half of an inch and about six inches.

39. A post terminal as recited in claim 38 wherein the vertical distance between said first ledge portion upper surface and said first ledge portion lower surface ranges from between about five eighths of an inch and about five inches.

40. A post terminal as recited in claim 39 wherein the vertical distance between said first ledge portion upper surface and said first ledge portion lower surface ranges from between about three quarters of an inch and about four inches.

41. A post terminal as recited in claim 28 wherein the horizontal distance between said first claw portion inside wall surface and said first claw portion outside wall surface is at least about one half of an inch.

42. A post terminal as recited in claim 41 wherein said horizontal distance between said first claw portion inside wall surface and said first claw portion outside wall surface ranges from between about one half of an inch and about six inches.

43. A post terminal as recited in claim 42 wherein said horizontal distance between said first claw portion inside wall surface and said first claw portion outside wall surface ranges from between about five eighths of an inch and about five inches.

44. A post terminal as recited in claim 43 wherein said horizontal distance between said first claw portion inside wall surface and said first claw portion outside wall surface ranges from between about three quarters of an inch and about four inches.

45. A post terminal as recited in claim 28 wherein said post terminal further comprises:

(a) a second post terminal side wall surface which is angularly oriented to said first and second post terminal faces, said angular orientation ranges from between about 30° to about 150°; and (b) a second ledge portion protruding outwardly from said second post terminal side wall surface.

46. A post terminal as recited in claim 45 wherein said second ledge portion has a lower surface which is angularly oriented to said second post terminal side wall surface, and wherein said angular orientation ranges from between about 45° to about 135°, said post terminal further comprising:

(a) a second claw portion extending downwardly from said second ledge portion, said second claw portion having an inside wall surface which is:

(i) angularly oriented to said second ledge portion lower surface, said angular orientation ranging from between about 45° to about 135°, and (ii) spaced laterally from said second post terminal side wall surface such that a channel is defined between said second post terminal side wall surface, said second ledge portion lower surface, and said second claw portion inside wall surface.

47. A post terminal as recited in claim 45 wherein said second ledge portion has an upper surface which is angularly oriented to said second post terminal side wall surface, and wherein said angular orientation ranges from between about 45° to about 135°, said post terminal further comprising:

(a) a first hook portion extending upwardly from said second ledge portion, said first hook portion having an inside wall surface which is:

(i) angularly oriented to said second ledge portion upper surface, said angular orientation ranging from between about 45° to about 135°, and (ii) spaced laterally from said second post terminal side wall surface such that a channel is defined between said second post terminal side wall surface, said second ledge portion upper surface, and said first hook portion inside wall surface.

48. A post terminal as recited in claim 28 further defining:

(a) at least a second polygonally-shaped cavity passing therethrough wherein the longitudinal axis of said second polygonally-shaped cavity is generally parallel to said longitudinal axis of said first polygonally-shaped cavity, and (b) at least a second hole passing through said second post terminal face, wherein the longitudinal axis of said second hole is:

(i) generally parallel to said longitudinal axis of said first hole, and (ii) generally perpendicular to said longitudinal axis of said second polygonally-shaped cavity, said second hole does not pass through said opposing first post terminal face.

49. A post terminal as recited in claim 48 further comprising:

(a) a second post terminal side wall surface which is angularly oriented to said first and second post terminal faces, said angular orientation ranges from between about 30° to about 150°; and (b) a second ledge portion protruding outwardly from said second post terminal side wall surface.

50. A post terminal as recited in claim 49 wherein said second ledge portion has a lower surface which is angularly oriented to said second post terminal side wall surface, and wherein said angular orientation ranges from between about 45° to about 135°, said post terminal further comprising:

(a) a second claw portion extending downwardly from said second ledge portion, said second claw portion having an inside wall surface which is:
(i) angularly oriented to said second ledge portion lower surface, said angular orientation ranging from between about 45° to about 135°, and
(ii) spaced laterally from said second post terminal side wall surface such that a channel is defined between said second post terminal side wall surface, said second ledge portion lower surface, and said second claw portion inside wall surface.

51. A post terminal as recited in claim 49 wherein said second ledge portion has an upper surface which is angularly oriented to said second post terminal side wall surface, and wherein said angular orientation ranges from between about 45° to about 135°, said post terminal further comprising:

(a) a first hook portion extending upwardly from said second ledge portion, said first hook portion having an inside wall surface which is:
(i) angularly oriented to said second ledge portion upper surface, said angular orientation ranging from between about 45° to about 135°, and
(ii) spaced laterally from said second post terminal side wall surface such that a channel is defined between said second post terminal side wall surface, said second ledge portion upper surface, and said first hook portion inside wall surface.

* * * * *